US011697072B1

(12) United States Patent
Henley

(10) Patent No.: US 11,697,072 B1
(45) Date of Patent: Jul. 11, 2023

(54) AMUSEMENT APPARATUS, COMPONENTS, AND, METHOD

(71) Applicant: Darrell M. Henley, Springfield, MO (US)

(72) Inventor: Darrell M. Henley, Springfield, MO (US)

( * ) Notice: Subject to any disclaimer, the term of this patent is extended or adjusted under 35 U.S.C. 154(b) by 0 days.

(21) Appl. No.: 17/365,187

(22) Filed: Jul. 1, 2021

Related U.S. Application Data

(63) Continuation of application No. 16/799,035, filed on Feb. 24, 2020, now Pat. No. 11,058,962, which is a continuation-in-part of application No. 16/594,571, filed on Oct. 7, 2019, now abandoned, which is a continuation of application No. 15/973,726, filed on May 8, 2018, now Pat. No. 10,456,695, which is a continuation-in-part of application No. 15/890,734, filed on Feb. 7, 2018, now abandoned.

(60) Provisional application No. 62/455,786, filed on Feb. 7, 2017.

(51) Int. Cl.
*A63G 31/08* (2006.01)
*A47D 1/00* (2006.01)

(52) U.S. Cl.
CPC ..... *A63G 31/08* (2013.01)

(58) Field of Classification Search
CPC ..... A63G 31/00; A63G 31/08; A47D 1/00; A47D 1/006
USPC ..... 472/43, 44, 47, 119, 125
See application file for complete search history.

(56) References Cited

U.S. PATENT DOCUMENTS

| | | | | |
|---|---|---|---|---|
| 758,579 | A | 4/1904 | Armstrong | A63G 9/00 |
| 1,215,110 | A | 2/1917 | Carey | A63G 9/16 |
| 1,469,910 | A | 10/1923 | Jacobs | A63G 9/16 |
| 2,076,113 | A | 4/1937 | Bartlett | A63G 9/16 |
| 2,222,119 | A | 11/1940 | Overholt | A63G 9/00 |
| 2,562,324 | A | 7/1951 | McBride | A63G 9/08 |
| 2,828,128 | A | 3/1958 | Castille | A63G 27/02 |
| 3,692,305 | A | 9/1972 | Allen | A63G 9/16 |
| 3,707,282 | A | 12/1972 | Robinson | A63G 27/04 |
| 3,778,054 | A | 12/1973 | Esposito, Jr. | A63G 9/00 |
| 3,883,136 | A | 5/1975 | Kim | A47D 13/109 |
| 3,904,194 | A | 9/1975 | Schwarzkopf | A63G 1/44 |
| 3,963,236 | A | 6/1976 | Mann | A63B 53/00 |
| 4,007,926 | A | 2/1977 | Ottaway | A63G 4/00 |
| 4,201,384 | A | 5/1980 | Barber | A63B 69/36 |
| 4,229,000 | A | 10/1980 | Scherling | A63B 5/10 |
| 4,754,969 | A | 7/1988 | Kobayashi | A63B 53/04 |
| 4,805,902 | A | 2/1989 | Casagrande | A47D 13/105 |
| 4,986,600 | A | 1/1991 | Leblanc et al. | B60N 2/3084 |
| 5,046,719 | A | 9/1991 | Comstock et al. | A63G 31/00 |
| 5,100,199 | A | 3/1992 | Vander Stel et al. | A61K 31/155 |
| 5,106,087 | A | 4/1992 | Simmons et al. | A63B 53/00 |

(Continued)

FOREIGN PATENT DOCUMENTS

EP 2762214 A1 8/2014 ..... A63G 27/04

*Primary Examiner* — Kien T Nguyen
(74) *Attorney, Agent, or Firm* — Jonathan A. Bay

(57) ABSTRACT

An amusement ride for locating on a ground leading to a ledge of a drop off has a pair of rocking boom, an axle, spokes and a passenger carrier. The pair of rocking booms are pivotally mounted near the ledge of the drop off. The axle is carried between the ends of rocking booms and when the rocking booms are tilted outboard of the ledge, the axle is suspended out over the empty space past the drop off. The spokes extending radially away from the axle to connections with the carrier. The axle is driven by a drive system to swing the carrier, from large arcs to full 360° revolutions.

17 Claims, 23 Drawing Sheets

(56) References Cited

U.S. PATENT DOCUMENTS

| | | | | |
|---|---|---|---|---|
| 5,224,756 | A | 7/1993 | Dukatz et al. | B60N 2/3084 |
| 5,267,906 | A | 12/1993 | Kitchen et al. | A63G 9/00 |
| 5,366,270 | A | 11/1994 | Heussner et al. | B60N 2/2878 |
| 5,385,384 | A | 1/1995 | Gierman et al. | B60N 2/3084 |
| RE34,868 | E | 2/1995 | Vander Stel et al. | B60N 2/3084 |
| 5,466,043 | A | 8/1995 | Crawley et al. | C07D 213/30 |
| 5,449,216 | A | 9/1995 | Geirman et al. | B60N 2/3084 |
| 5,472,260 | A | 12/1995 | Czapski et al. | B60N 2/3084 |
| 5,474,357 | A | 12/1995 | Dukatz et al. | B60N 2/3084 |
| 5,498,062 | A | 3/1996 | Holdampf | B60N 2/3084 |
| 5,527,223 | A | 6/1996 | Kitchen et al. | A47D 9/00 |
| 5,564,780 | A | 10/1996 | Presser et al. | B60N 2/2878 |
| 5,573,465 | A | 11/1996 | Kitchen et al. | A63G 9/00 |
| 5,588,700 | A | 12/1996 | Homier | B60N 2/3084 |
| 5,647,634 | A | 7/1997 | Presser et al. | B60N 2/2878 |
| 5,649,866 | A | 7/1997 | Balwanz | A63G 9/00 |
| 5,658,201 | A | 8/1997 | Kleimeyer et al. | A63G 27/00 |
| 5,688,178 | A | 11/1997 | Emrie | A63G 1/38 |
| 5,782,699 | A | 7/1998 | Harrap | A63G 9/00 |
| 5,803,815 | A | 9/1998 | Kitchen | A63G 27/00 |
| 5,810,671 | A | 9/1998 | Balwanz et al. | A63G 31/08 |
| 5,827,124 | A | 10/1998 | Kleimeyer et al. | A63G 1/08 |
| 5,842,928 | A | 12/1998 | McGinnis | A63G 9/00 |
| 5,899,534 | A | 5/1999 | Gray | B60N 2/3084 |
| 5,931,740 | A | 8/1999 | Kitchen | A63G 9/12 |
| 5,957,779 | A | 9/1999 | Larson | A63G 1/44 |
| 5,989,127 | A | 11/1999 | Kitchen et al. | A63G 31/00 |
| 6,231,454 | B1 | 5/2001 | Teramoto | A63B 53/00 |
| 6,368,227 | B1 | 4/2002 | Olson | A63G 9/00 |
| 6,416,418 | B1 | 7/2002 | Kleimeyer | A63G 9/00 |
| 6,440,002 | B1 | 8/2002 | Jackson | A63G 9/00 |
| 6,511,381 | B1 | 1/2003 | Cochron | A63G 9/00 |
| 6,620,051 | B2 | 9/2003 | Kroon et al. | A63G 27/04 |
| 6,626,492 | B1 | 9/2003 | Uno | B60N 2/265 |
| 6,699,135 | B2 | 3/2004 | Cochron | A63G 9/00 |
| 6,808,459 | B2 | 10/2004 | Checketts | A63G 9/16 |
| 6,875,118 | B1 | 4/2005 | Checketts | A63G 9/16 |
| 6,908,151 | B2 | 6/2005 | Meeker et al. | B60N 2/2806 |
| 7,066,822 | B2 | 6/2006 | Cochron | A63G 9/00 |
| 7,070,239 | B1 | 7/2006 | Ugrekhelidze et al. | B60N 2/3084 |
| 7,159,941 | B2 | 1/2007 | Thomas | B60N 2/2863 |
| 7,229,132 | B2 | 6/2007 | Meeker et al. | B60N 2/2806 |
| 7,547,066 | B2 | 6/2009 | Mendenhall | B60N 2/28 |
| 7,637,568 | B2 | 12/2009 | Meeker et al. | B60N 2/2806 |
| 7,744,476 | B2 | 6/2010 | Knijpstra | A63G 27/04 |
| 7,758,120 | B2 | 7/2010 | Zink et al. | B60N 2/2866 |
| 7,823,974 | B2 | 11/2010 | Mendenhall | B60N 2/2866 |
| 7,837,267 | B2 | 11/2010 | Zink et al. | B60N 2/2866 |
| 7,857,385 | B2 | 12/2010 | Zink et al. | B60N 2/2851 |
| 7,887,140 | B1 | 2/2011 | Forlivio | B60N 2/26 |
| 7,914,384 | B2 | 3/2011 | Roodenburg et al. | A63G 7/00 |
| 8,371,951 | B2 | 2/2013 | Nemeth et al. | A63G 1/28 |
| 8,684,853 | B2 | 4/2014 | Peters et al. | A63G 1/28 |
| 9,132,356 | B2 | 9/2015 | Giordano | A63G 9/00 |
| 9,272,223 | B2 | 3/2016 | Checketts | A63G 9/04 |
| 9,290,114 | B2 | 3/2016 | Herut | B60N 2/2878 |
| 2003/0017880 | A1 | 1/2003 | Kleimeyer | A63G 9/00 |
| 2004/0077415 | A1 | 4/2004 | Kleimeyer | A63G 7/00 |
| 2004/0192453 | A1 | 9/2004 | Esparza et al. | A63G 9/08 |
| 2006/0035715 | A1 | 2/2006 | Threlkel | A63G 9/00 |
| 2008/0143158 | A1 | 6/2008 | Roodenberg et al. | A63G 7/00 |
| 2010/0062868 | A1 | 3/2010 | Mordelt | A63J 5/12 |
| 2013/0085004 | A1 | 4/2013 | Thomas | A63G 9/00 |
| 2014/0368006 | A1 | 12/2014 | Taylor | A47D 1/0081 |
| 2015/0232059 | A1 | 5/2015 | Zamperla | B60R 22/12 |
| 2015/0251567 | A1 | 9/2015 | Cohen | B60N 2/286 |
| 2016/0243451 | A1 | 8/2016 | Burger | A63G 7/00 |
| 2017/0119172 | A1 | 5/2017 | Sclare | A47D 1/0083 |
| 2018/0326876 | A1 | 11/2018 | Oswald | B60N 2/2866 |

AMUSEMENT APPARATUS, COMPONENTS, AND, METHOD

CROSS-REFERENCE TO PROVISIONAL APPLICATION(S)

This application is a continuation of U.S. patent application Ser. No. 16/799,035, filed Feb. 24, 2020, now U.S. Pat. No. 11,058,962; which is a continuation-in-part of U.S. patent application Ser. No. 16/594,571, filed Oct. 7, 2019, which is a continuation of U.S. patent application Ser. No. 15/973,726, filed May 8, 2018, now U.S. Pat. No. 10,456,695, which is a continuation-in-part of U.S. patent application Ser. No. 15/890,734, filed Feb. 7, 2018; which claims the benefit of U.S. Provisional Application No. 62/455,786, filed Feb. 7, 2017. The foregoing patent disclosure(s) is(are) incorporated herein by this reference thereto.

BACKGROUND AND SUMMARY OF THE INVENTION

The invention relates to amusement apparatus and, more particularly, to various rides or attractions including without limitation swings, Ferris wheels, base jumping (ie., bungee jumping), bungee trampoline (with or without the trampoline) and so on.

It is an object of the invention to provide a pair of rocking booms mounted at the ledge of a drop off to suspend an amusement ride out over the empty space past the drop off.

It is a further object of the invention that such an amusement ride comprises for example and without limitation a swinging (passenger) carrier suspended from a swing axis extending between the distal ends of the rocking booms.

It is an alternative object of the invention to provide the above rocking booms with an angular degree of backwards tilting away from the ledge to pick-up passengers for the amusement ride at 'ground' level.

It is an additional object of the invention to configure the rocking booms (relative to spokes suspending the swinging carrier) such that the rocking booms can lift the swinging carrier over a safety barrier at the ledge of the drop off, and thereafter suspend the swinging carrier out into empty space past the drop off.

It is still another object of the invention to swing the swinging carrier (when suspended out past the drop off) in full 360° rotations.

It is a further object of the invention to provide the swinging carrier with one or more passenger seats which can adapted for passengers ranging between children to large adults:—for example that is, between extremes of a thirty-six inch tall, thirty-five pound child (~1 m, 16 kg), and, an immense adult, perhaps exceeding four hundred and fifty pounds (~200 kg).

It is a corresponding object of the invention to achieve the foregoing with an array of different-sized inserts (eg., booster seats).

It is yet another object of the invention that the rocking booms can tilt all the way backward to land on the 'ground,' or very close to the 'ground,' in order to bring the booms in closer to the 'ground' for maintenance and/or protection from extreme weather like high winds.

A number of additional features and objects will be apparent in connection with the following discussion of the preferred embodiments and examples with reference to the drawings.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains. In the drawings.

FIG. 9 is a side elevational view of comparable to FIG. 8, except showing the carrier swinging in full 360° revolutions;

FIG. 13 is a rear elevational view comparable to FIG. 4 except showing that the swinging passenger carrier is expandable in individual seat stations in even numbers (because it is preferred to arrange the seat stations in back-to-back pairs) from four to six, eight, ten, twelve and so on;

FIG. 18 is a side elevational view comparable to FIG. 17 except showing the accommodation of two different sized passengers, the passenger on the right sitting on the permanent seat form of that seat station on that side of the passenger carrier, and the passenger on the left sitting on an appropriated sized insert which (1) which is connected by hooking on lugs provided therefor, (2) nests inside the permanent seat form of the seat station on that other side of the passenger carrier, and (3) forms its own seat form which is scaled accordingly for a smaller sized passenger than the permanent seat form is scaled for;

DETAILED DESCRIPTION OF THE PREFERRED EMBODIMENTS

Figure 1:
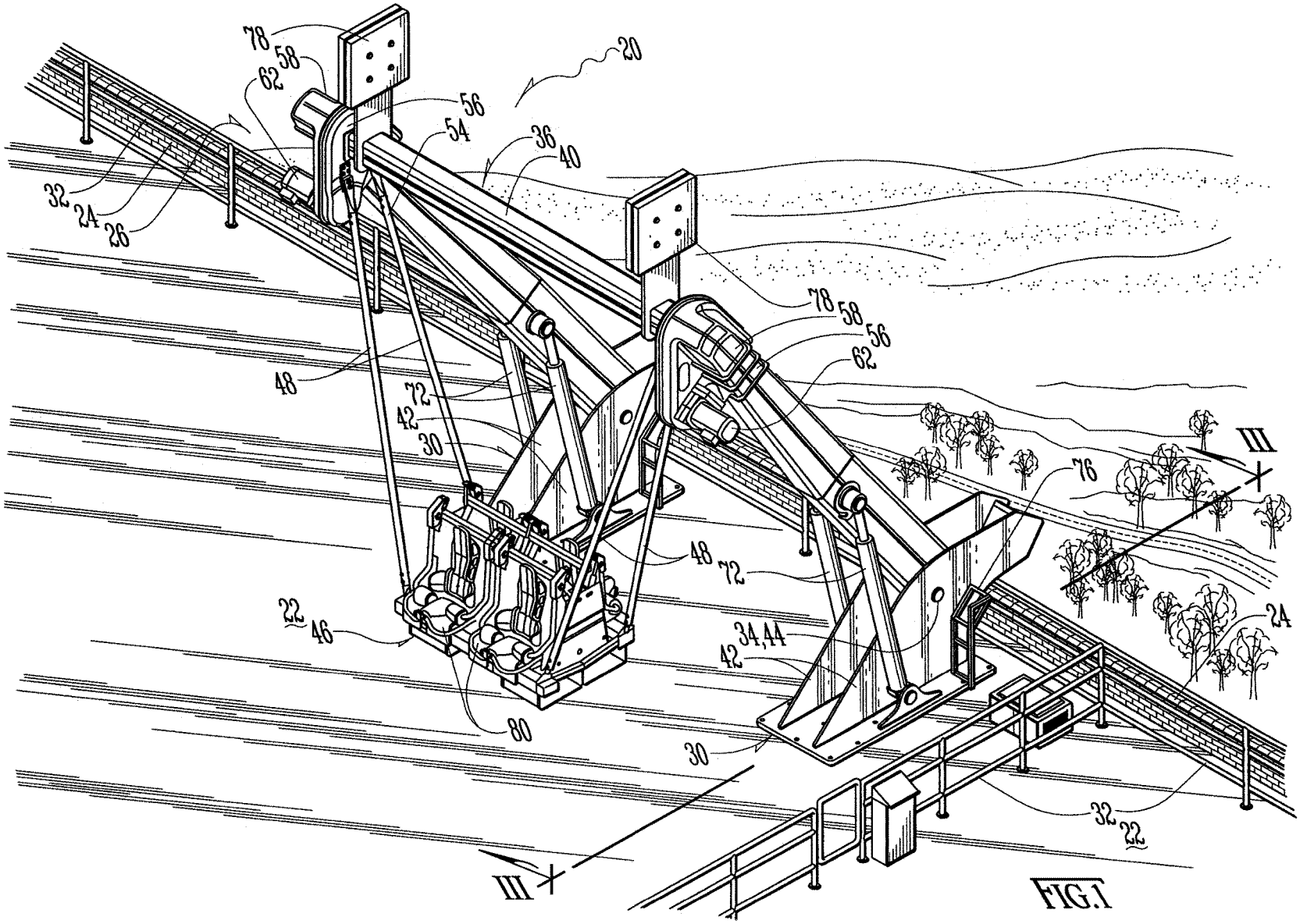
FIG. 1 is a perspective view of an exemplary embodiment of amusement apparatus, components, and method in accordance with the invention, wherein this exemplary embodiment comprises (for example and without limitation) a swing.
Figure 2:
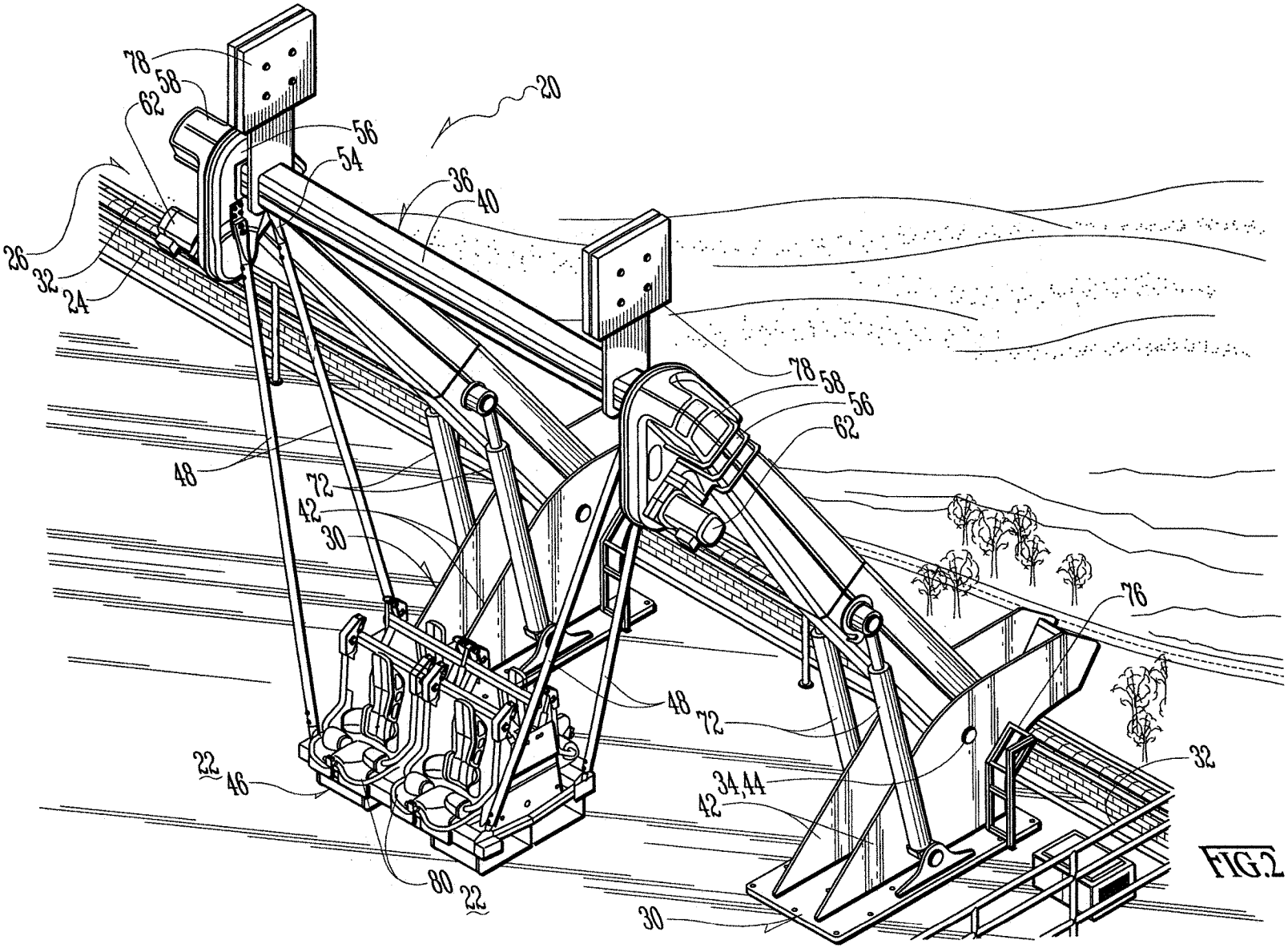
FIG. 2 is a perspective view comparable to FIG. 1 except on an enlarged scale.
Figure 3:
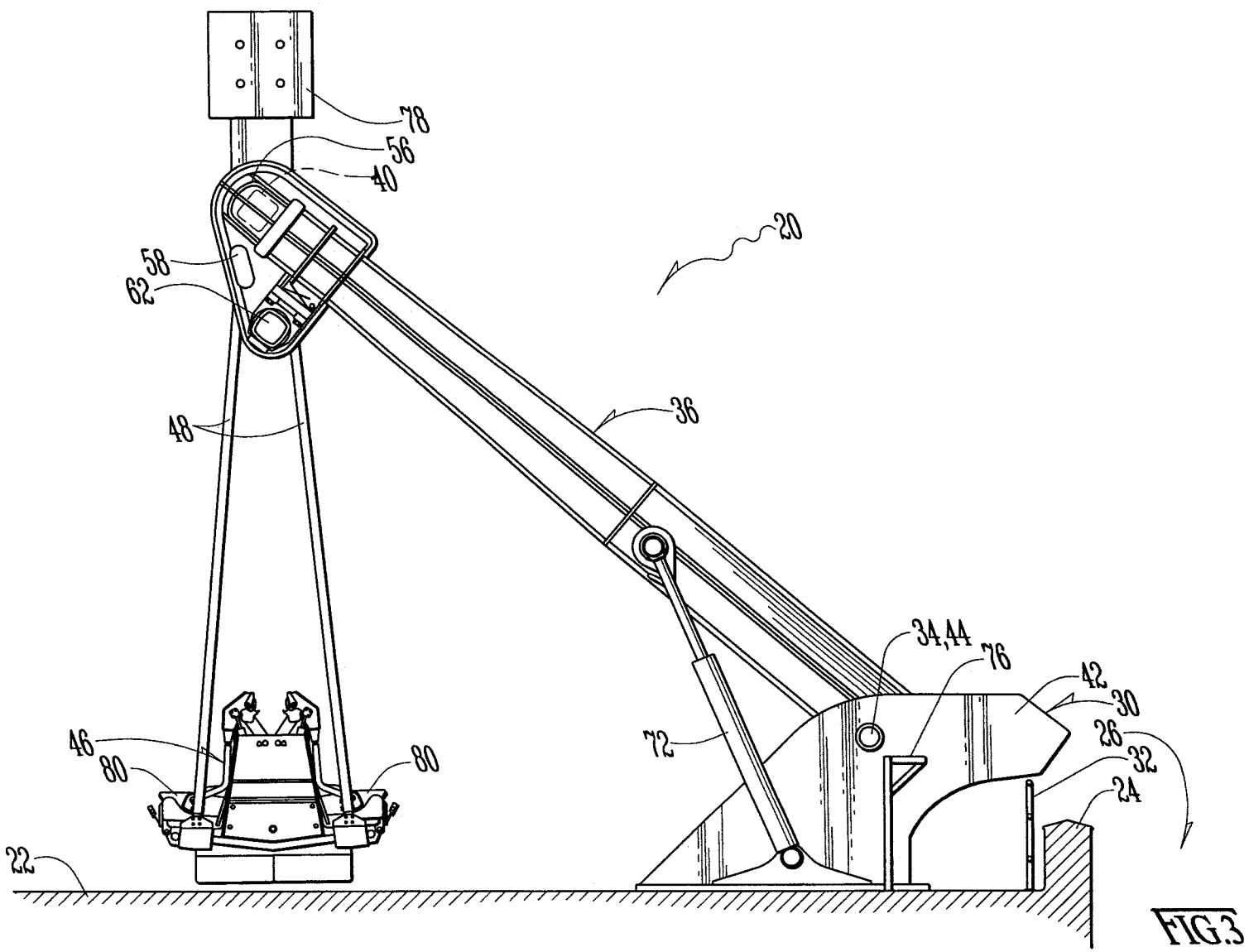
FIG. 3 is a side elevational view of FIG. 2.
Figure 4:
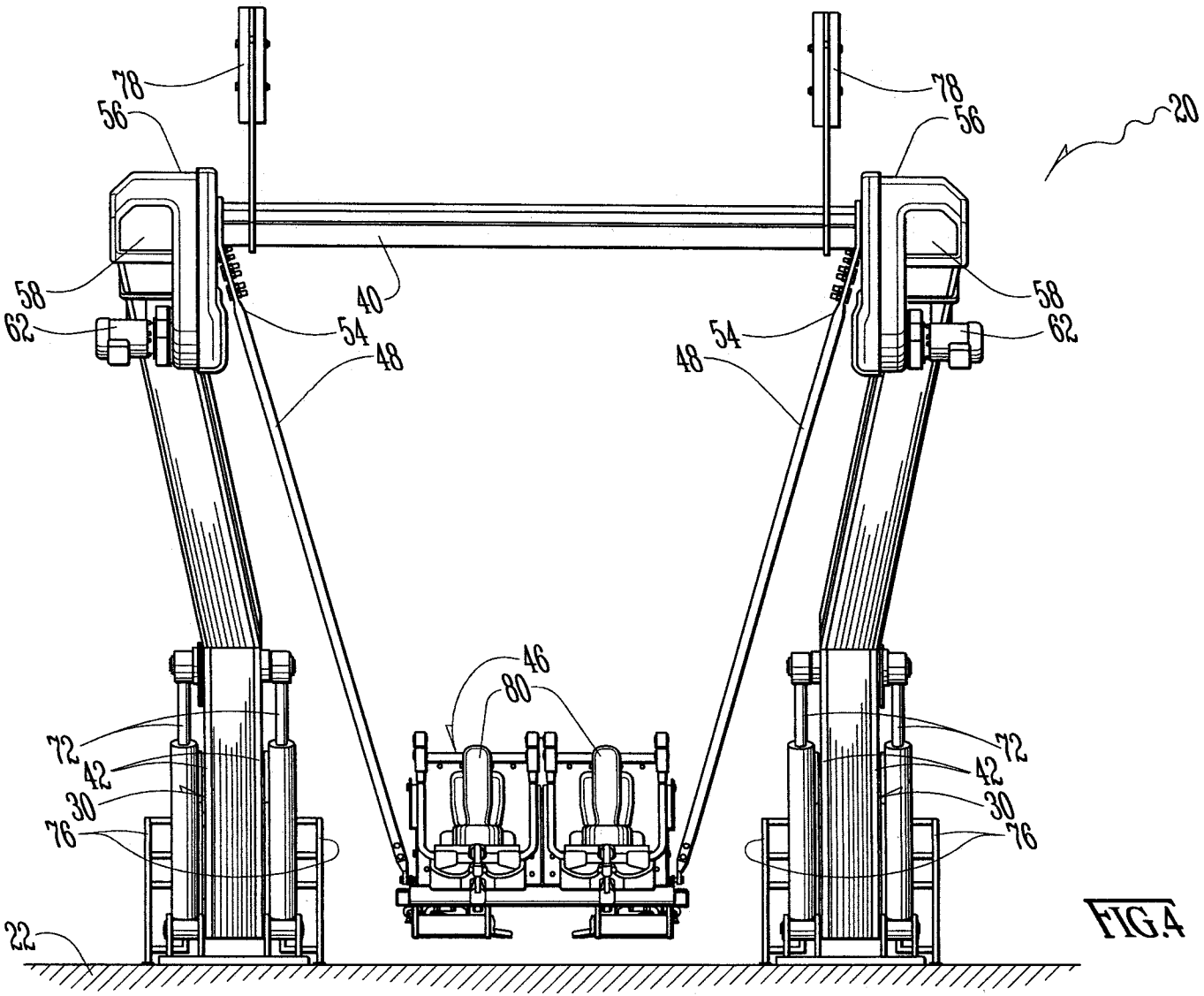
FIG. 4 is a rear elevational view of FIG. 3.

The drawings show an amusement ride 20 in accordance with the invention advantageously configured for placement on a 'ground' 22 close to a ledge 24 of a drop off 26.

Typical envisioned 'grounds' 22 include without limitation:—

- any roofs or decks of Buildings,
- the decks of Bridges,
- any decks or platforms associated with Barges,
- any decks or platforms associated with Flat bed trailers,
- any decks or platforms associated with Observation towers/antennas,
- the ground behind Retaining walls,
- any decks or platforms associated with Ball stadiums,
- any decks or platforms associated with Cruise ships,
- the ground above Cave overhangs,
- the ground above Cliffs,
- any decks or platforms associated with Piers/wharves, and so on. The 'ground' 22 need not be perfectly horizontal nor perfectly level.

The drawings show for example and without limitation an amusement ride 20 in the nature of a swinging ride. The amusement ride 20 comprises a spaced pair of base mounting structures 30 secured to the 'ground' 22 close to and generally parallel to the ledge 24 of the drop off 26. The 'ground' 22 in the drawings is illustrated as (for example and without limitation) a flat roof of multi-story commercial building. The drop off 26 is the side of building. The ledge 24 is the edge of the roof. For safety purposes, the ledge 24 is guarded by a safety barrier 32 like a wall or handrail.

The base mounting structures 30 define between themselves a generally horizontal fulcrum axis 34, which otherwise might be referred to as a rocking axis 34. Each base mounting structure 30 pivotally supports a rocking boom 36. Thus there are a pair of rocking booms 36. The rocking booms 36 extend from the common rocking axis 34 therefor to distal ends 30 which are spanned by a cross bar 40 preferably serving as an axle 40. The base mounting structures 30 resemble clevis-style brackets (or alternatively, bascule-bridge style mounts) having spaced sidewalls 42 flanking the respective rocking boom 36 where the respective rocking boom 36 is pivotally supported on a spindle 44 or bearing or the like.

The amusement ride 20 includes a swinging passenger carrier 46. The passenger carrier 46 is suspended by spokes 48 from the axle 40. That is, the passenger carrier 46 is 'suspended' at rest, but is not truly 'suspended' while being driven in swinging motions. There are two spokes 48 for each of the left and right sides of the axle 40, but equivalent substitutions could include a single wedge-shaped spoke (not shown). The spokes 48 preferably are relatively stiff rather than flaccid.

The axle 40 might instead be merely a cross bar 40. The spokes 48 might preferably be flaccid and tethered to the cross bar 40 such that the cross bar 40 can be rotated and thereby winch the carrier 46 relatively closer to or further away from the cross bar 40.

The spokes 48 might be stiff or flaccid and might swing on an axis that is not coincident with the central axis of the cross bar 40 (this is not shown). The inner ends 54 of the spokes 48 might be fixed to some structures near the distal ends 56 of the booms 36 but spaced slightly away from the cross bar 40 (nor is this shown).

It is preferred however to provide a fully rotating axle 40 from which the spokes 48 are suspended, either directly or indirectly. The distal ends 56 of the booms 36 support opposed drive system housings 58. The drive system housings 58 would enclose brakes (not shown). The drive system 62 for the axle 40 turns the axle 40, preferably including in full 360° revolutions. The drive system housings 56 are stationary with the distal ends 56 of the booms 36. The preferred drive means 62 includes opposed electric motors 62, one at each end of the axle 40.

To return back to the rocking booms 36, they are driven by their own drive system 72 to tilt between angular extremes of about 9 o'clock and 3 o'clock on an imaginary clock dial.

It is an arbitrary choice, but for the sake of establishing a direction for description's sake, the 'counterclockwise' direction is chosen to signify the tilting of the booms 36 from the 12 o'clock position on the imaginary clock dial to retreat away from the ledge 24 over the 'ground' 22. The 'clockwise' direction is chosen to signify the tilting of the booms 36 from the 12 o'clock position on the imaginary clock dial to project out over into the empty space above the drop off 26. A more narrow range of preferred angular extremes for the tilting of the booms 36 might included without limitation being between 9:15 on the imaginary clock face, and, 1:30.

The drive system 72 for driving the tilt of the booms 36 is illustrated for example and without limitation to be hydraulic, comprising hydraulic cylinders. The base mounting structures 30 include stop surfaces 76 at the 'clockwise' extremes (ie., the angular outboard extremes for the tilt booms out over the drop off, or, 1:30 on the arbitrary clock face). That way, the hydraulics 72 are relieved from having to hold a fixed position for the booms 36 in the outboard extreme position during all the dynamic forces felt or applied while the swinging carrier 46 is being rotated.

The axle 40 is rotatably supported in the drive system housings 58 by bearings or the like, and driven by any of gear, chain or pulley couplings and the like by the electric motors 62. Hence the axle 40 (or otherwise the carrier 46) is driven for motion by drive mechanics 62 which are independent of the drive mechanics 72 for the rocking booms 36. The drawings show for example and without limitation that the rocking booms 36 are driven by a hydraulic system 72, which is independent and not coupled the drive system 62 for the swinging carrier 46, which the drawings show for example and without limitation to be an electric drive system, such as by virtue of electric motors 62.

The spokes 48 preferably rotate with the axle 40, or, if the axle 40 is generally fixed to ends of the rocking booms 36, the spokes 48 preferably rotate with sleeves about the axle 40 (this is not shown). That way, the amusement ride 20 can include the provisions of counterweights 78 to counterbalance the swinging carrier 46 during swinging.

Figure 5:
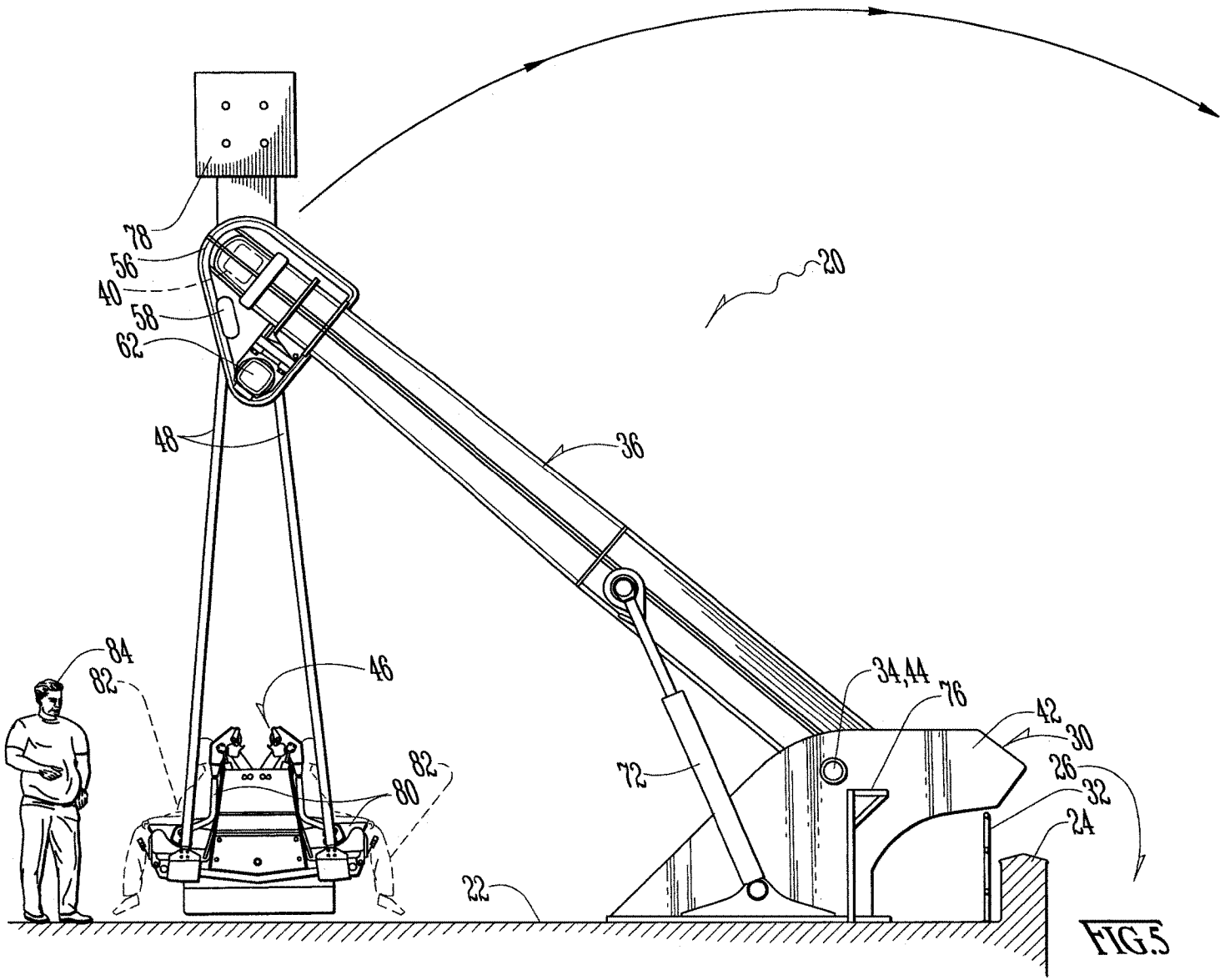
FIG. 5 is a side elevational view of comparable to FIG. 3 except showing passengers loading into the seats of the carrier.
Figure 10:
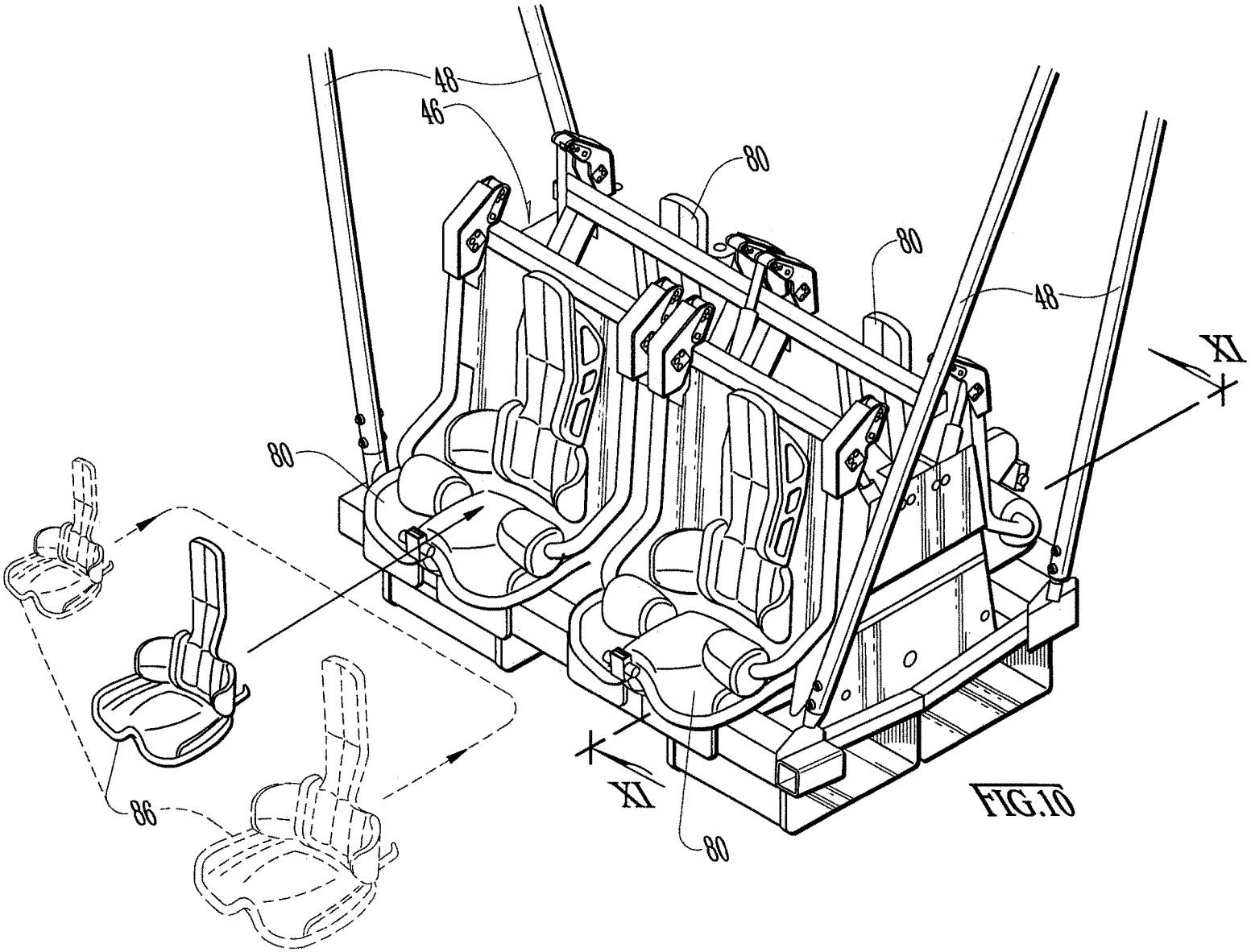
FIG. 10 is an enlarged scale perspective view of the passenger carrier of the amusement apparatus in accordance with the invention, with a hook-in insert shown exploded and which provides an effective seat sized for children.

FIG. 10 shows, for example, that the swinging carrier 46 can be configured with four individual passenger seats 80. Two seats 80 face clockwise, and the other two counterclockwise. FIG. 5 shows better that, it is an aspect of the invention that the rocking booms 36 tilt 'inboard' sufficiently (eg., counterclockwise in the example above) to allow passengers 82 to board (seat themselves in) the seats 80 the directly from the level of 'ground' 22. This eliminates the need for any steps or ladders and the like (none shown).

Figure 6:
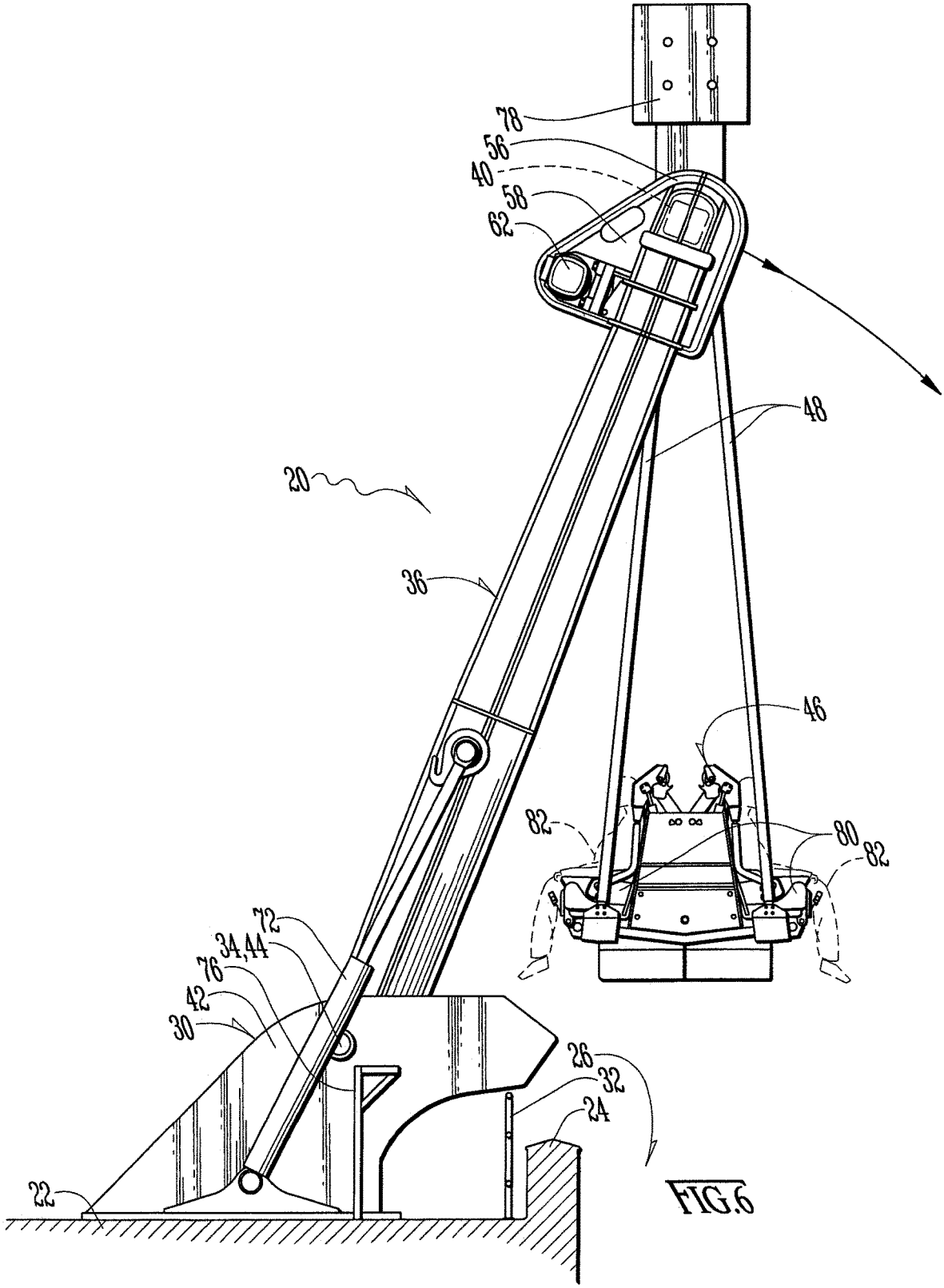
FIG. 6 is a side elevational view of comparable to FIG. 5 except showing the pair of booms in the process of pivoting toward a forward extreme tilted position therefor.
Figure 7:
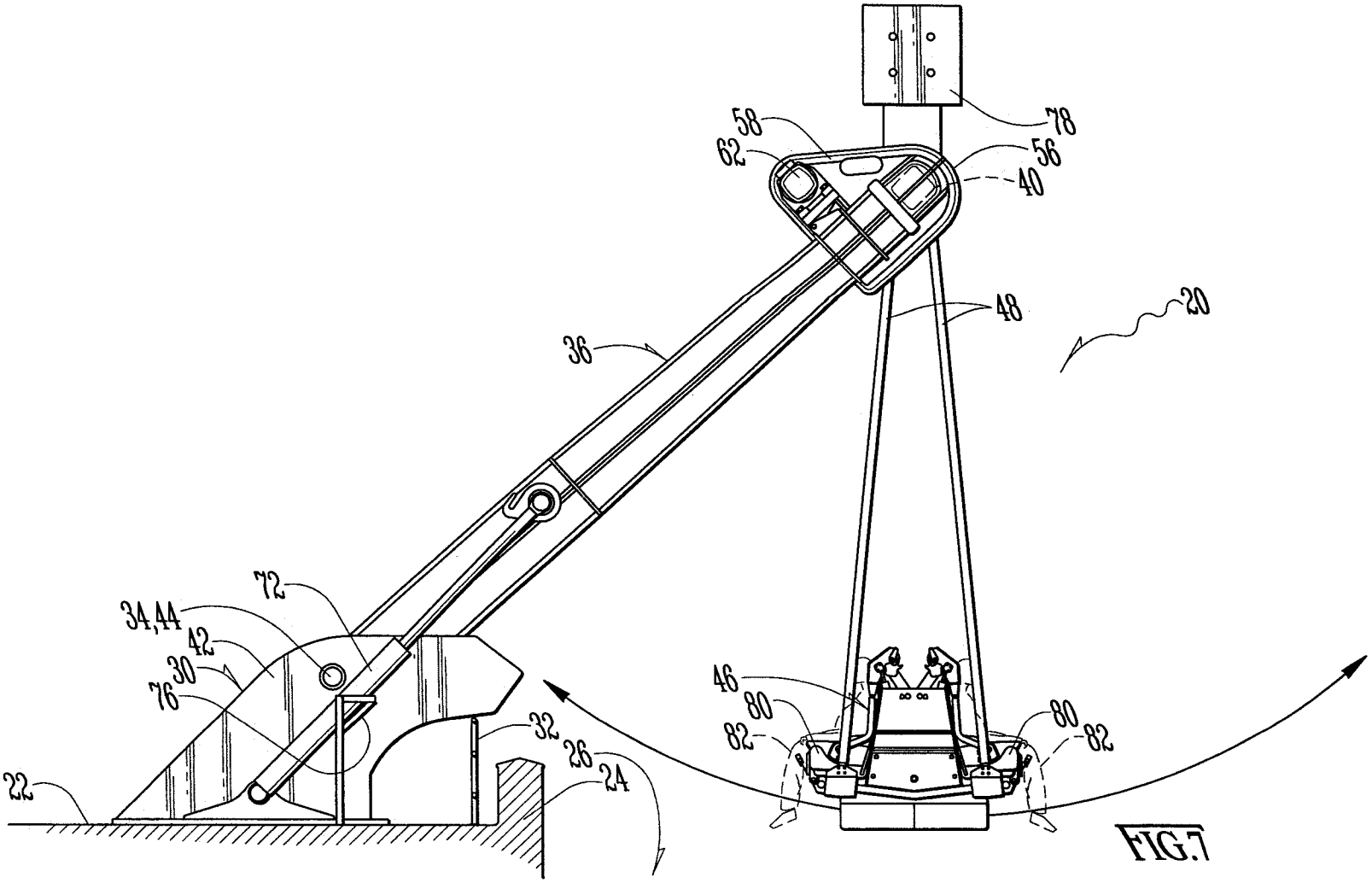
FIG. 7 is a side elevational view of comparable to FIG. 6, except in this instance showing the pair of booms pivoted and stopped at the forward extreme tilted position, and also showing the carrier swinging between acute extremes (ie., less than 90° apart)
Figure 8:
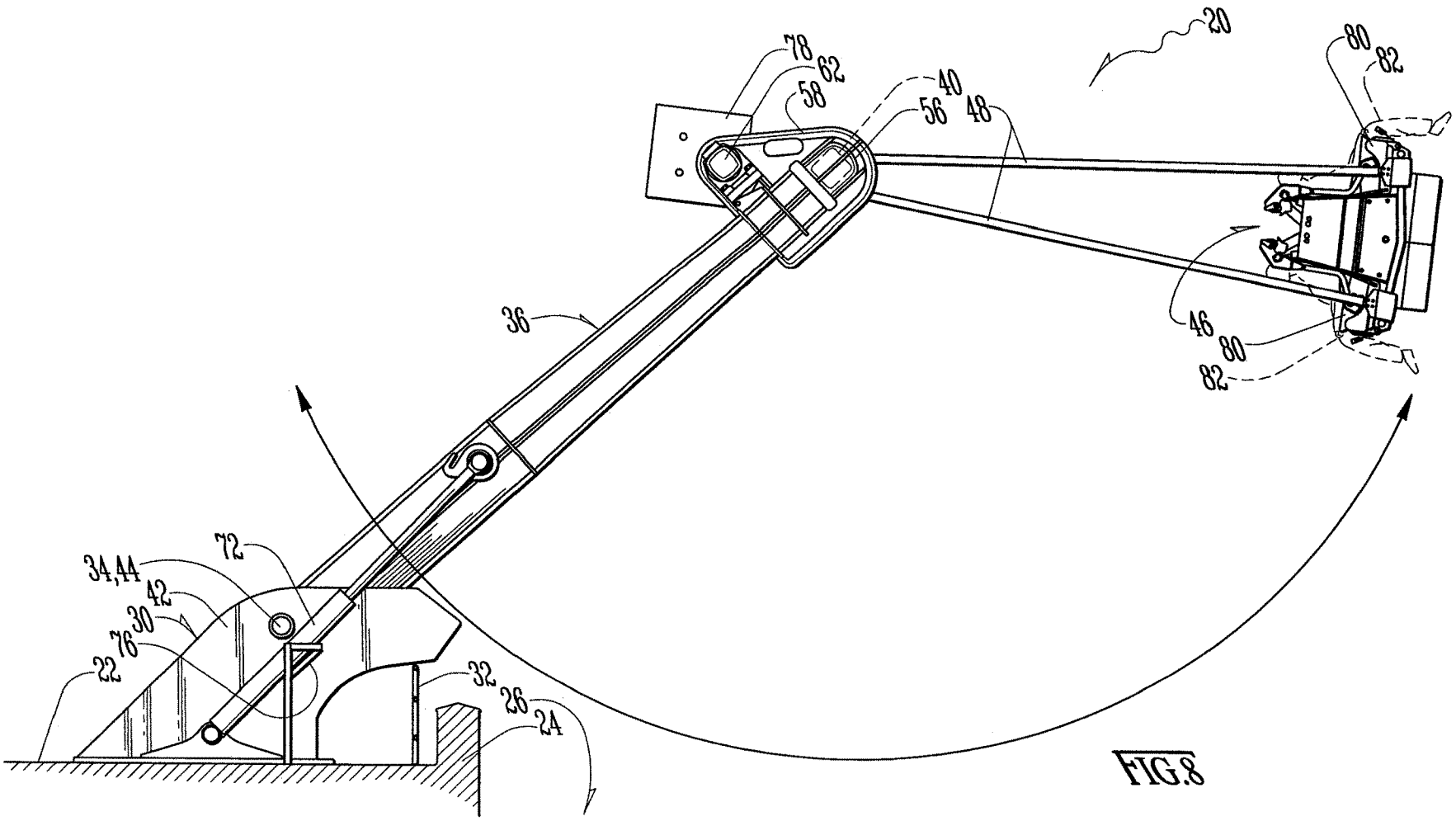
FIG. 8 is a side elevational view of comparable to FIG. 7, except showing the carrier swinging between obtuse extremes (between 180° and 90° apart)
Figure 6:
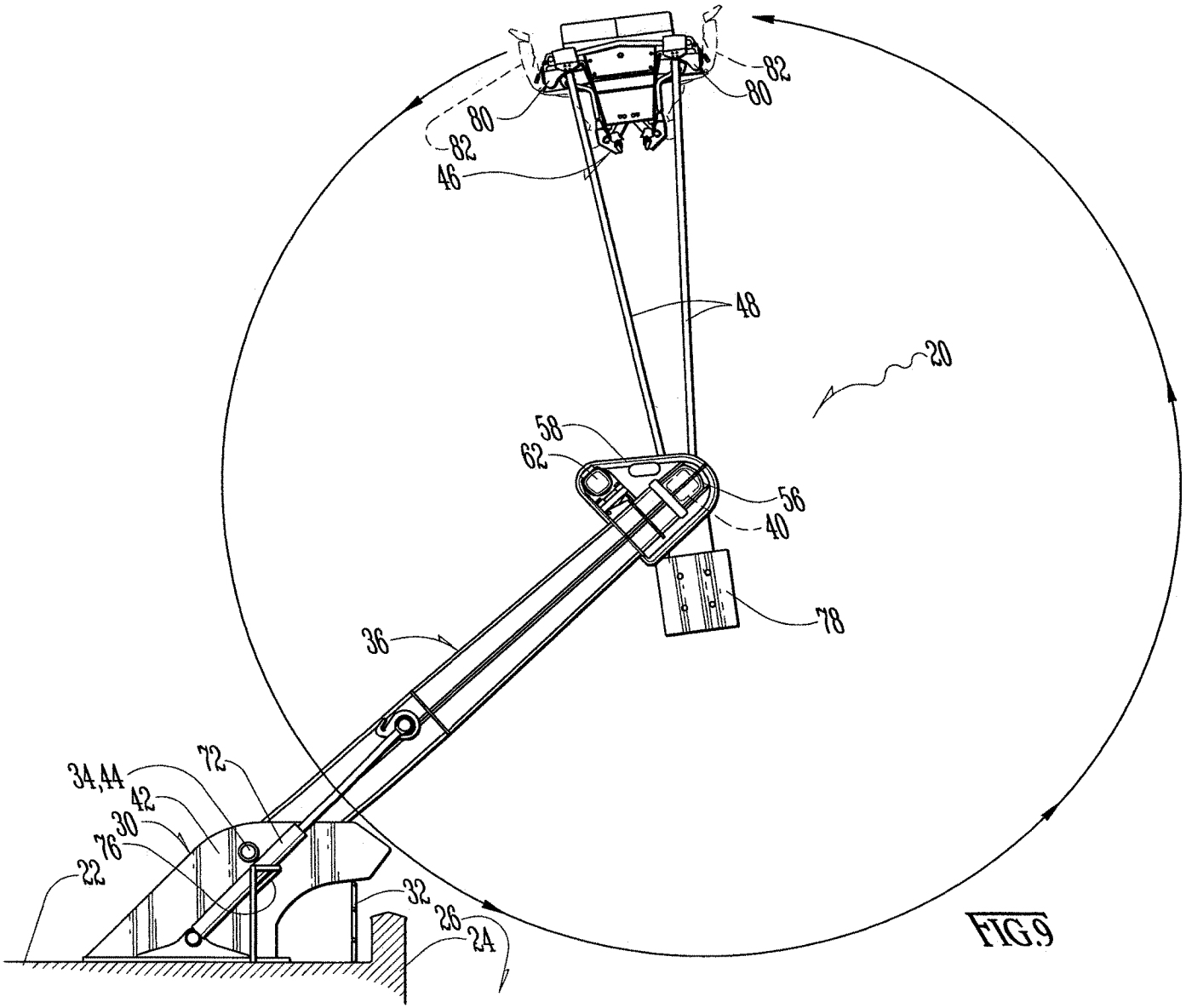

FIGS. 6 and 7 show better that, it is an additional aspect of the invention to configure the rocking booms 36 (relative to spokes 48 suspending the swinging carrier 46) such that the rocking booms 36 can lift the swinging carrier 46 over the safety barrier 32 at the ledge 24 of the drop off 26, and thereafter suspend the swinging carrier 46 out into empty space past the drop off 26.

It is another aspect of the invention to provide the option of, giving ride control over to the passengers 82 rather than a ride-control operator 84. That is, it is an aspect of the invention that either (1) the passengers 82 or (2) the ride-control operator 84 can determine whether the swinging carrier 46 will rotate in full revolutions, or, between arc extremes. The choices can be varied over a range from relatively minimum to relatively maximum including without limitation any of:— acute extremes (ie., less than 90° apart),
obtuse extremes (between 180 and 90° apart),
reflex extremes (greater than 180° apart), or
full 360° rotations.

It is another aspect of the invention to provide the swinging carrier 46 with one or more passenger seats 80 which can adapted for passengers 82 ranging between children to large adults:—for example that is, between extremes of a thirty-six inch tall, thirty-five pound child (~1 m, 16 kg), and, an immense adult, perhaps exceeding four hundred and fifty pounds (~200 kg).

Figure 11:
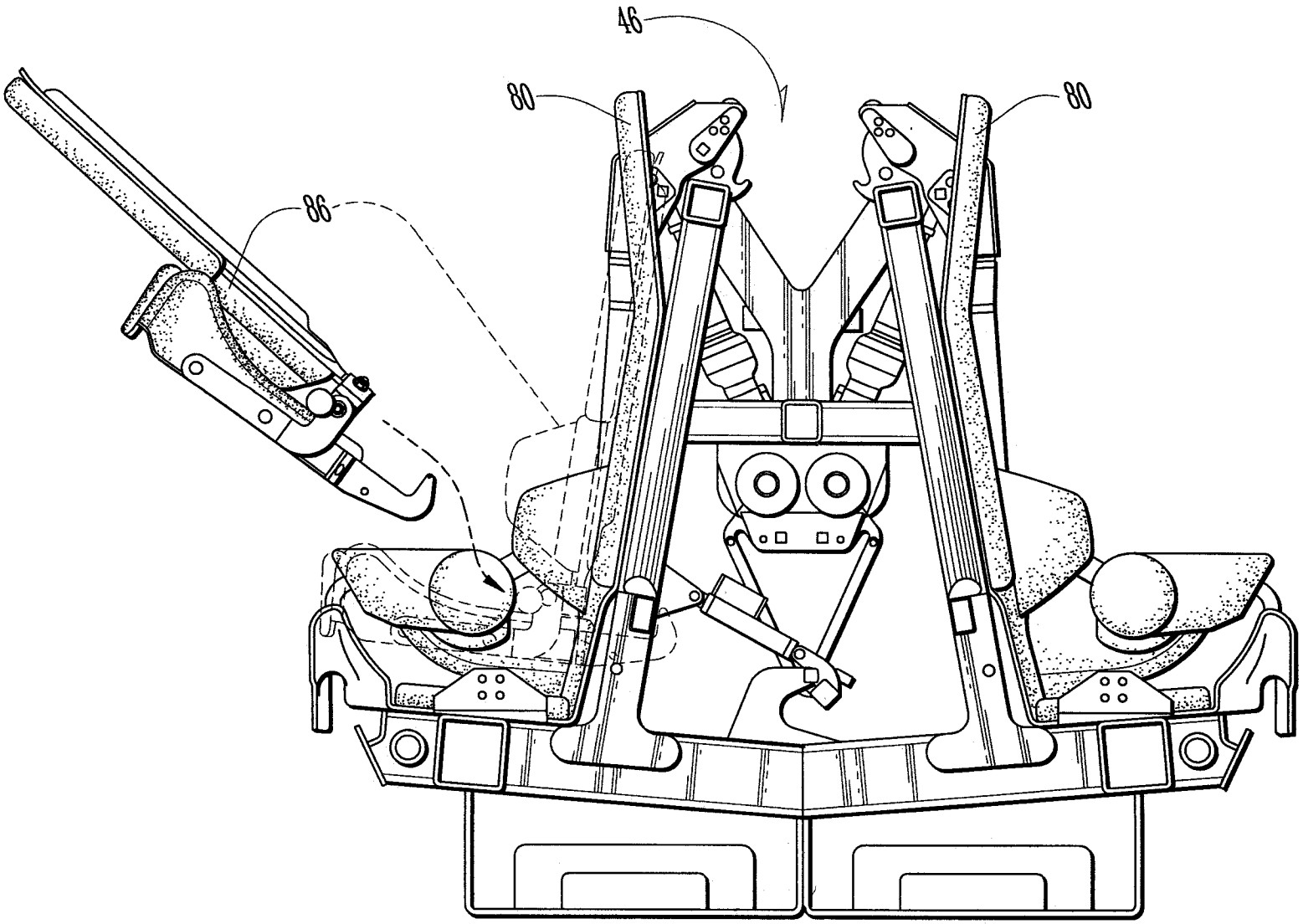
FIG. 11 is a side elevational view taken in the direction of arrows XI-XI in FIG. 10.

FIGS. 10 and 11 show the carrier 46 constructed with four seats 80 (for example and without limitation). Each seat 80 can receive a hook-in insert 86 to provide an effective seat sized for a certain range of passenger heights and weights. Preferably there are an array of different sized inserts 86 available, each designed for a target height and weight range. In effect, the smallest inserts 86 function in part as a booster seat. Such inserts 86 allow the ride 20 to be enjoyed by a wide cross-section of amusement seekers 82.

Figure 12:
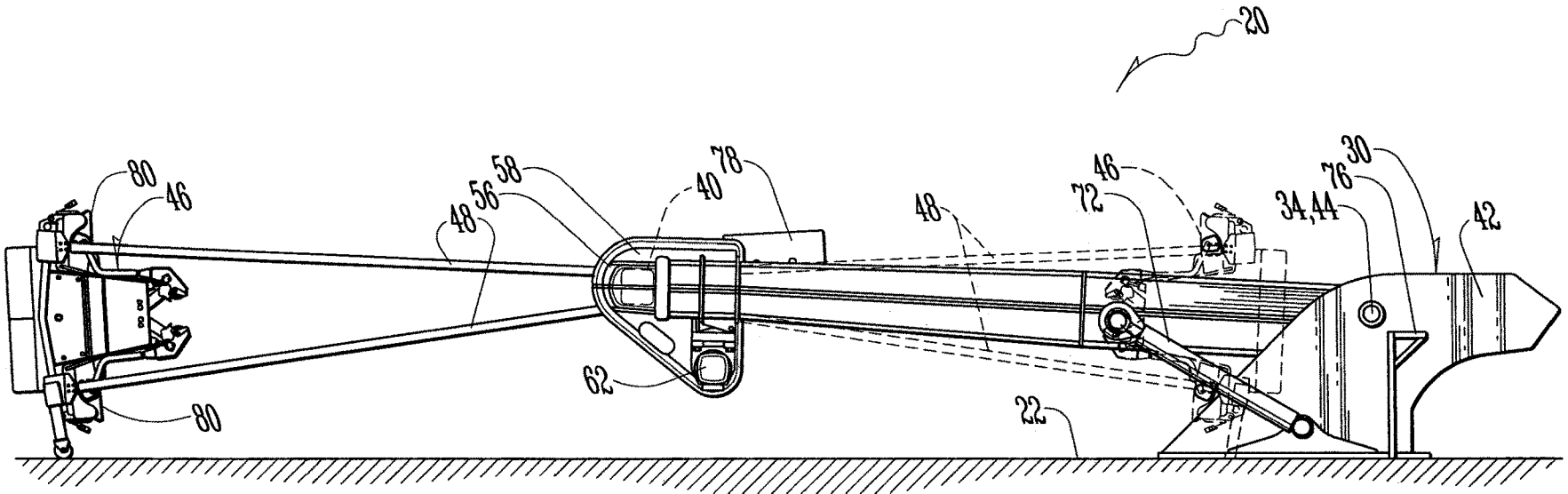
FIG. 12 is a side elevational view of comparable to FIG. 7, except showing the booms pivoted and stopped at (or nearly at) a rearward extreme tilted position.

FIG. 12 shows that the rocking booms 36 can tilted (lowered) all the way backward to land on the 'ground' 22, or at least very close to the 'ground' 22. This flexibility allows the booms 36 to be brought in closer down to the 'ground' 22 for maintenance and/or protection from extreme weather like high winds.

More attention will be given now to passenger accommodation aspects 100 in accordance with the invention. Among other things, it is an object of the invention to provide the swinging carrier 46 with one or more passenger seats 80 which can adapted for passengers 82 ranging between children to large adults:—for example that is, between extremes of a thirty-six inch tall, thirty-five pound child (~1 m, 16 kg), and, an immense adult, perhaps exceeding four hundred and fifty pounds (~200 kg).

Figure 13:
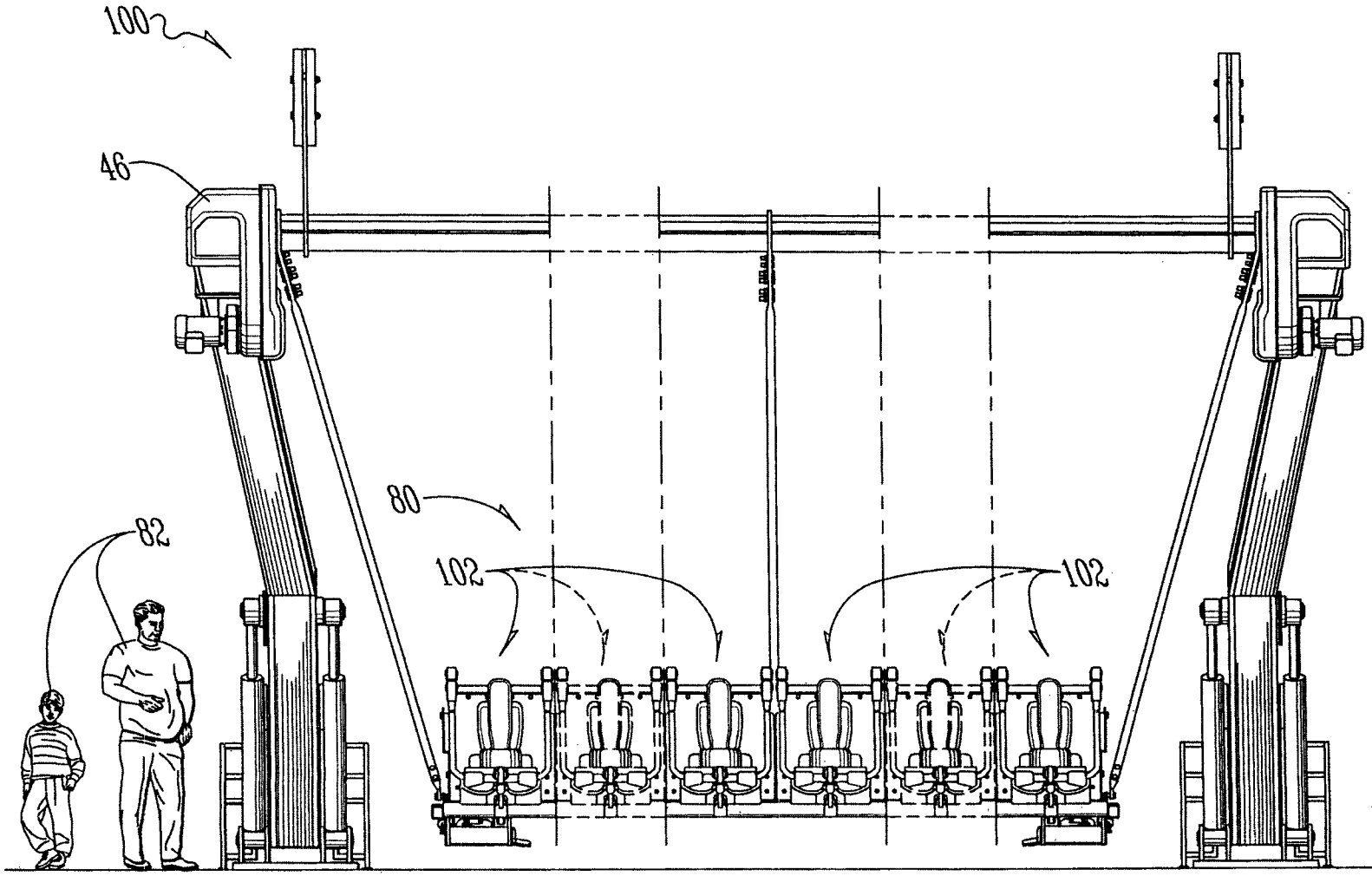

The swinging passenger carrier 46 can be reckoned as providing a fixed number of seat stations 102. For example, FIG. 13 shows that the swinging passenger carrier 46 is expandable in individual seat stations 102 in even numbers (because it is preferred to arrange the seat stations 102 in back-to-back pairs) from four to six, eight, ten, twelve and so on. There are four seat stations 102 shown in solid line, and there would be counterpart opposite-direction facing seat stations 102 behind the four shown in solid line. There are two additional seat stations 102 shown in dashed line, and again there would be counterpart opposite-direction facing seat stations behind the two seat stations 102 shown in dashed line.

Figure 14:
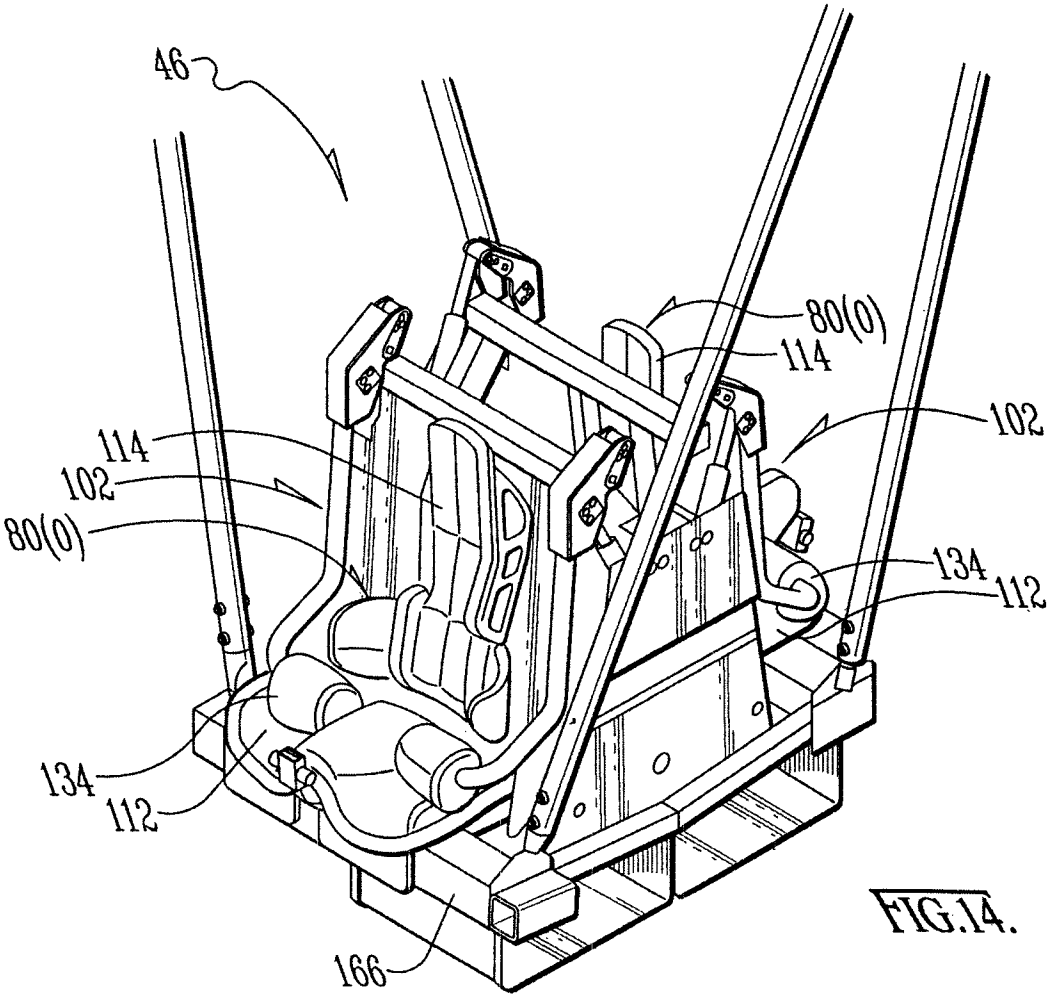
FIG. 14 is a perspective view comparable to FIG. 10 except showing that the swinging passenger carrier has been down-sized in individual seat stations to just two, but still (as preferred) in a back-to-back arrangement.

FIG. 14 shows that the swinging passenger carrier 46 can been down-sized in individual seat 102 stations to just two, but still (as preferred) in a back-to-back arrangement. One seat station 102 faces a first direction, the other seat station 102 faces the opposite direction.

Figure 15:
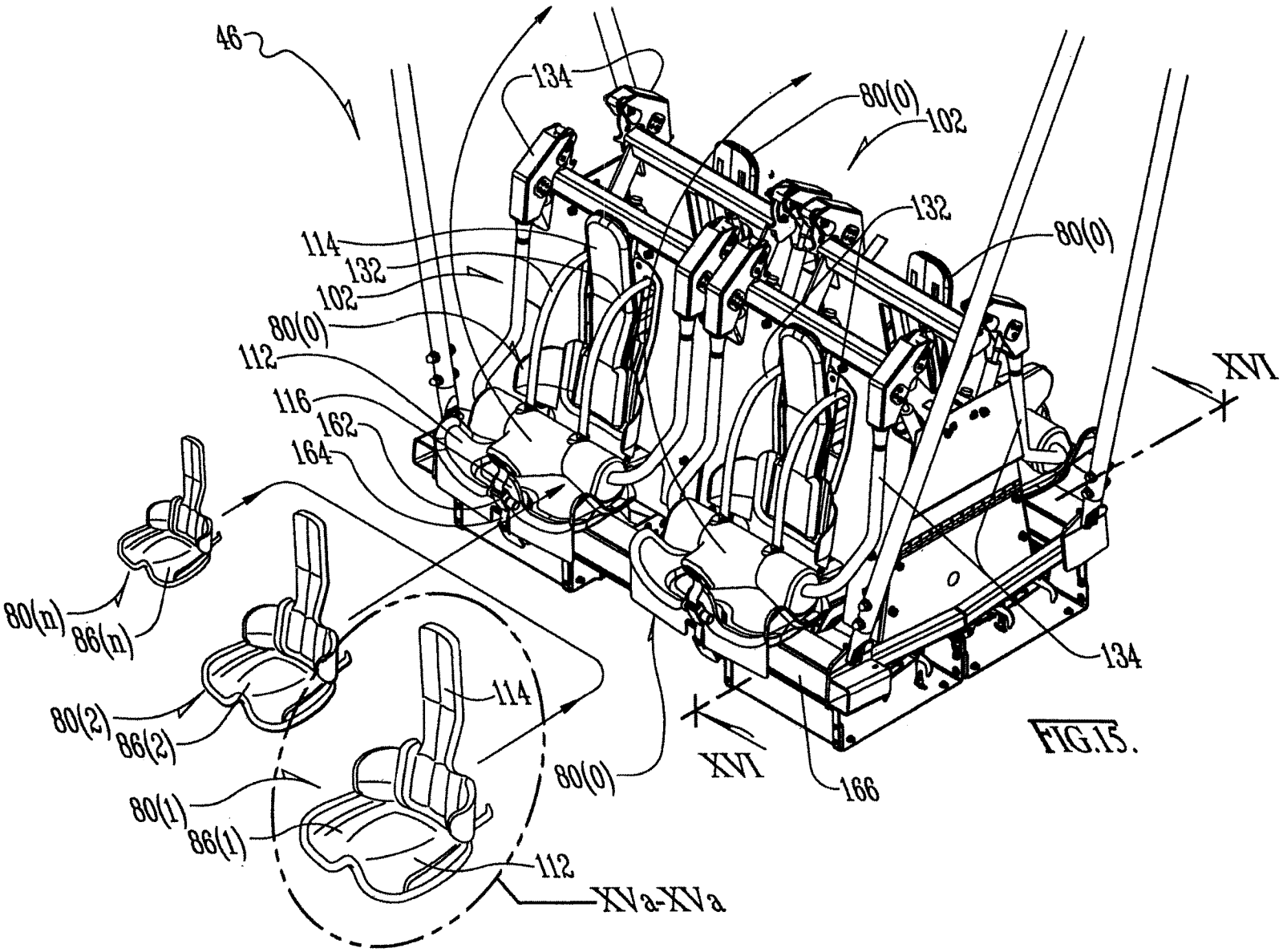
FIG. 15 is a perspective view comparable to FIG. 10 except including depiction of left-and right shoulder strap for each seat station (shoulder straps for the rearward facing seat stations not in view)
Figure 15A:
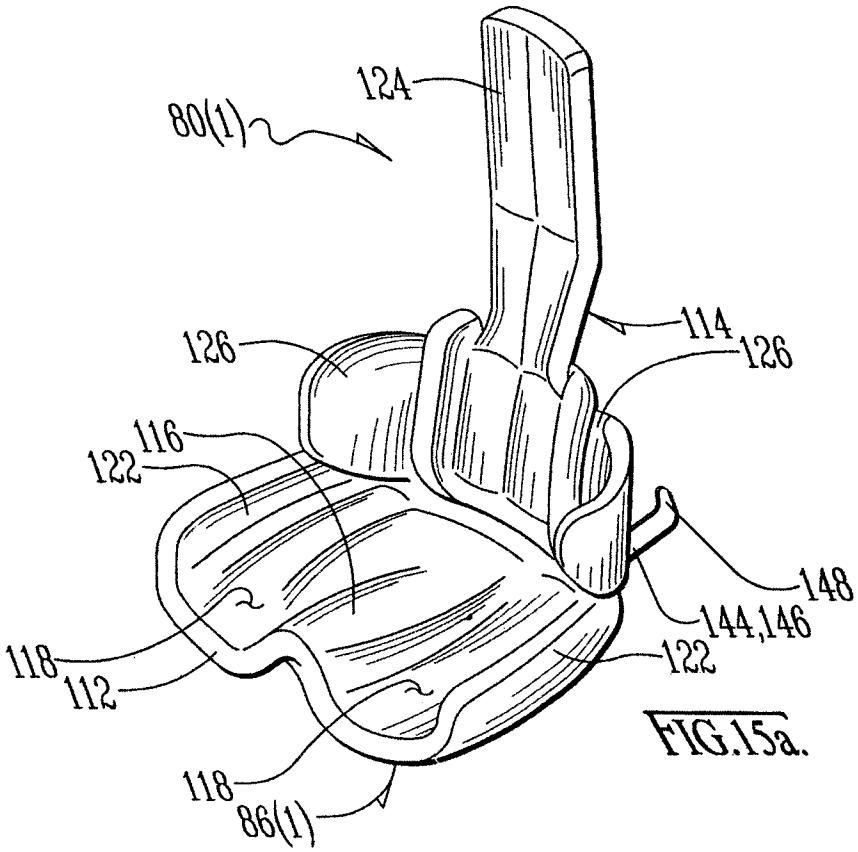
FIG. 15A is an enlarged-scale perspective view of detail XVA-XVA in FIG. 15.

FIG. 15 shows a swinging passenger carrier 46 with two side-by-side seat stations 102 facing a first direction, and back-to-back counterpart seat stations 102 facing the opposite direction. FIG. 15 furthermore shows that any one seat station 102 can serve as a dock—which "dock" service is essentially performed by permanent seat form 80(0) as more particularly described below—for receiving a nesting, booster seat insert 86. Three such booster seat inserts 86(1), 86(2) and 86(*n*) are shown.

Thus as shown by FIG. 15, there are four (4) sizes for seat 80. For convenience of naming sake but otherwise not limiting the seats anything in particular, the four (4) choices can be reckoned as extra-large 80(0), large 80(1), medium 80(2) and small 80(*n*).

The extra-large option is a permanent seat form 80(0) that is formed in each seat station 102. The large 86(1), medium 86(2) and small inserts 86(*n*) nest into the extra-large, permanent seat form 80(0) and thus function as booster seats.

Each seat form 80(0), 80(1), 80(2) and 80(*n*) is characterized by a seat portion 112 and a back-rest portion 114. The seat portions 112 and back-rest portions 114 can be provided with extra features or options. For example, it is preferred to provide a contoured seat portion 112 with a central pommel rise 116 flanked between shallow grooves 118 and further between spaced away low rising thigh rests 122 (eg., thigh-hugging side rises). Again for example, it might be preferred to provide the back-rest portions 114 with not only a head-rest portion 124 but also conforming hip hugging portions 126.

FIG. 15 also shows left-and right shoulder straps 132 are provided for each seat station 102 (wherein the shoulder straps 132 for the rearward facing seat stations 102 are not in view).

Figure 16:
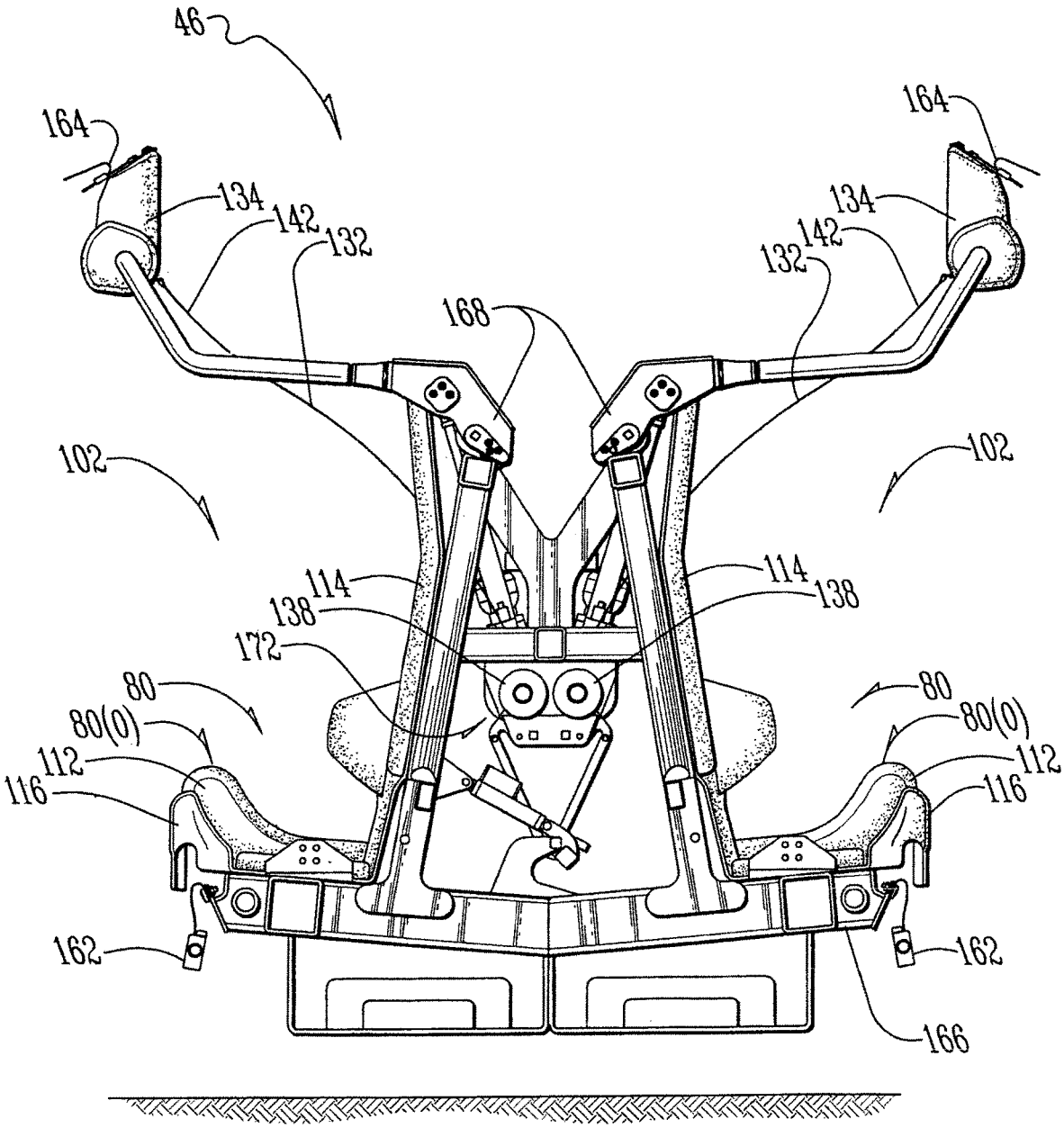
FIG. 16 is a side elevational view taken in the direction of arrows XVI-XVI in FIG. 15.

FIG. 16 is a side elevational view of FIG. 15, showing lap bar restraints 134 and further showing the lap bar restraints 134 raised. The shoulder straps 132 extend between proximal ends 136 wound up in a reel device 138 therefor (as better shown in FIGS. 21 and 22 and more particularly described below), and, distal ends 142 affixed to the lap bar restraints 134 about centered with the respective pommel 116 of the respective seat form 80. Hence raising the lap bar restraints 134 concurrently raises the shoulder straps 132 up and lets passengers 82 get into and get out of the seats 80 (passengers not shown).

Figure 17:
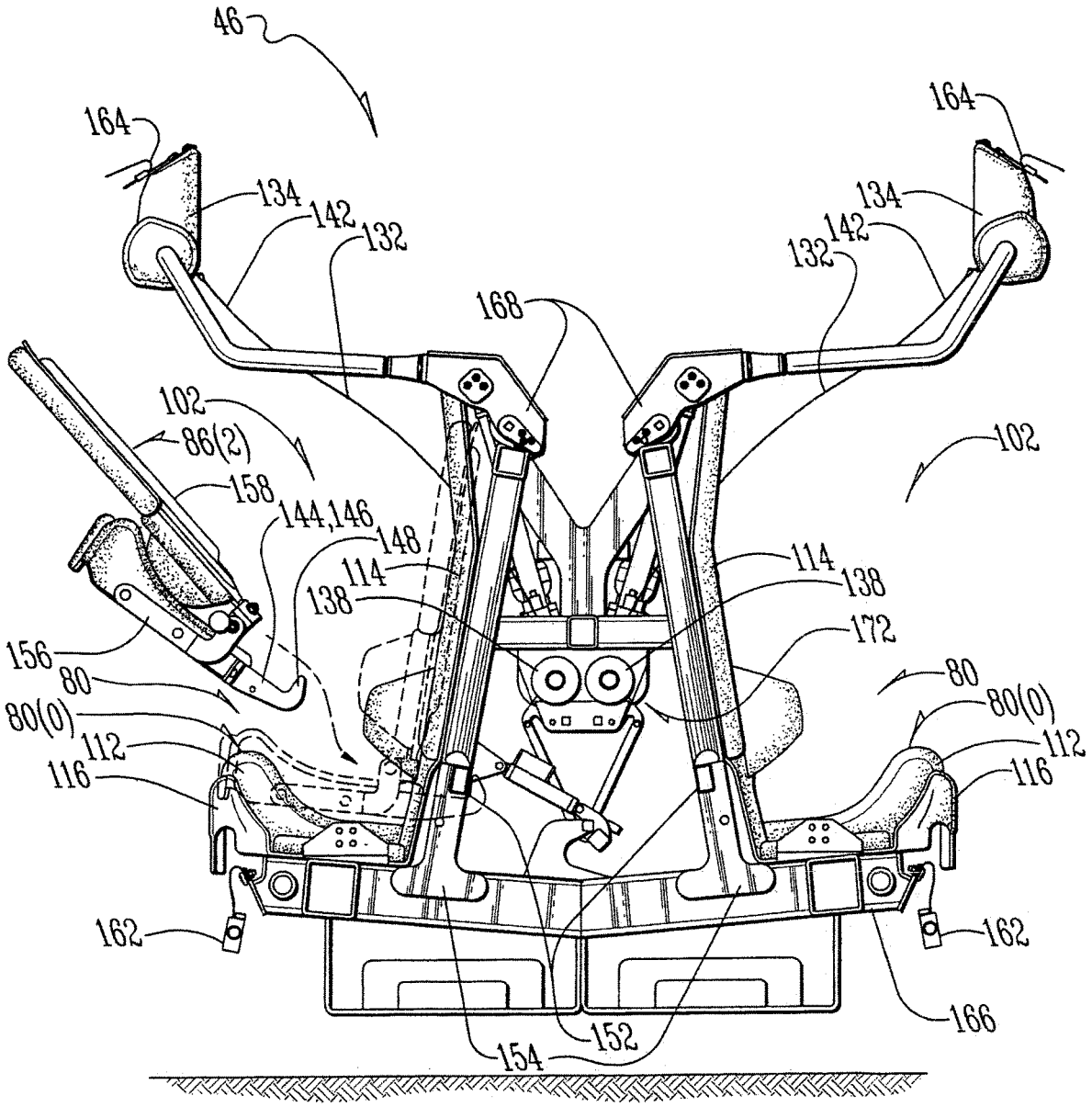
FIG. 17 is a side elevational view comparable to FIG. 16 except showing the flight path of a representative one of the booster seat inserts into a docking position on one of the permanent seat forms of the respective seat station of the passenger carrier.

FIG. 16 shows that both the left seat station 102 and right seat station 102 are in the extra-large seat form 80(0) configuration, meaning that the permanent seat form 80(0) in the left seat station 102 and right seat station 102 is bare for use, and not covered by any booster seat insert (eg., 86(1)). In contrast, FIG. 17 shows the flight path of a representative one of the booster seat inserts 86(1) into a docking position on left-side permanent seat form 80(0) of the left-side seat station 102 of the swinging passenger-carrier 46 (needless to say, left and right are relative to the point of view).

The booster seat insert 86(1) has a left and right hook structure 144 extending out from the plane of the seat portion 112 and rearwardly relative to the forward-facing direction of the seat portion 112 and back-rest portion 114. Each hook structure 144 is plate steel formed with a shank portion 146 terminating in an upward hook portion 148. The hook structures 144 dock into respective holding structures 152. A non-limiting example of a holding structure 152 might be a short cross-bar, or even a lug if not spanning between two sidewalls 154. The preference is to have a short cross-bar 152 spanning between two sidewalls 154, but the outboard sidewall is broken away from view and only an inboard sidewall 154 is shown.

Figure 18:
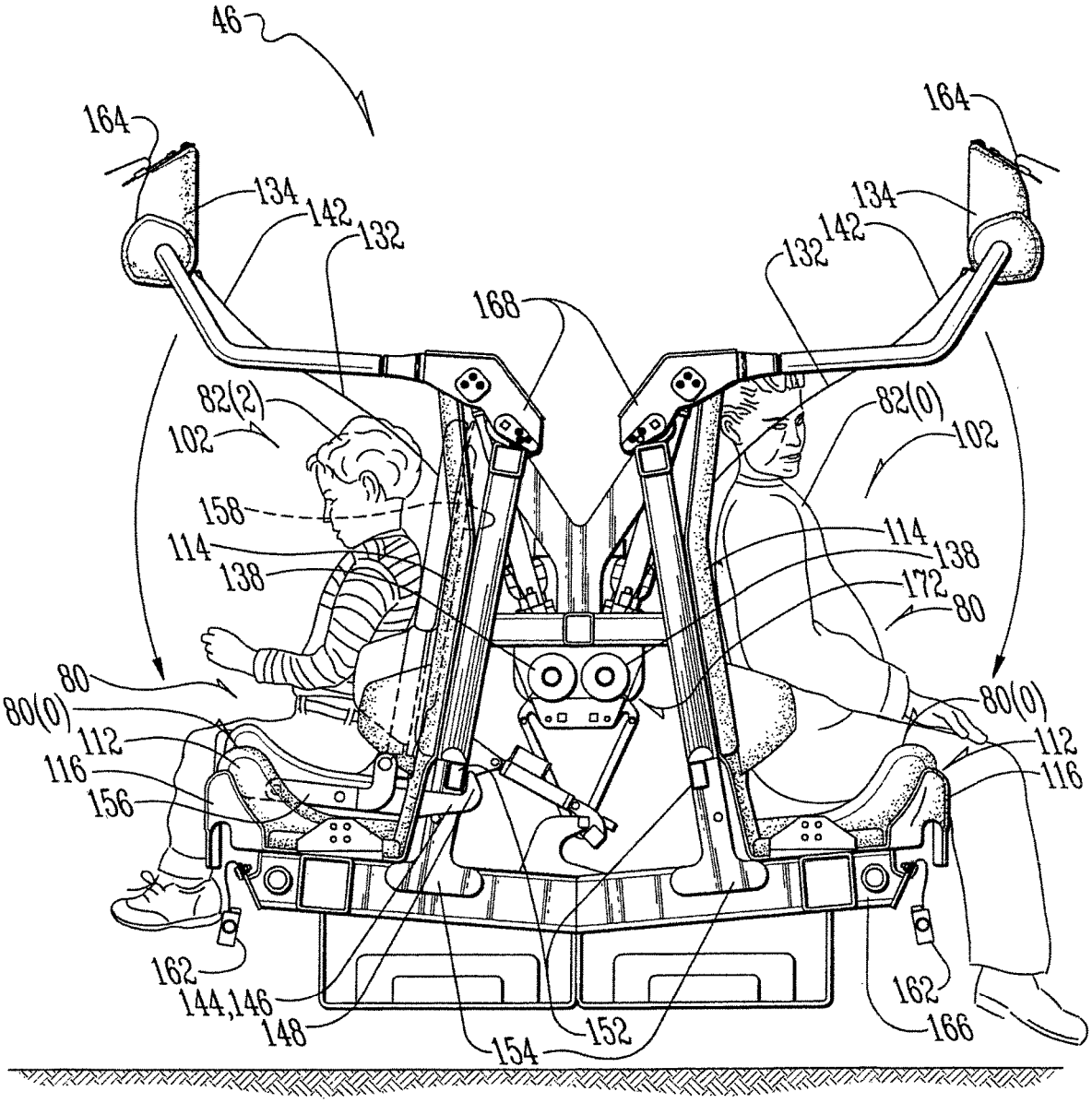

FIG. 18 shows the accommodation of two different sized passengers 82(0) and 82(2). The left-side passenger 82(2) might be reckoned as medium-sized, or at least within a range of sizes that the medium-sized booster seat insert 86(2) is scaled for. The passenger 82(0) on the right might be reckoned as an extra-large sized passenger, and hence he is sitting on the permanent seat form 82(0) of that right-side seat station 102 of the swinging passenger-carrier 46.

The booster seat insert 86(2) on the left is connected by hooking the hook structures 144 onto left-side (near-side in this view) and right-side (far-side in this view) cross-bars 152 (or lugs) as shown and provided therefor. Here, the reference to left and right is relative to the seated passenger, and not the vantage point of the view. Only the left-side (near-side in this view) cross bar 152 (or lug) is in view.

The booster seat insert 86(2) nests within the permanent seat form 80(0) of the seat station 102 on the left-side (left relative point of view) of the swinging passenger-carrier 46. The booster seat insert 86(2) has an under surface contour 156 and back surface contour 158 which complements the contours 116/118/122 and 124/126, respectively, of the seat portion 112 and back-rest portion 114 of the permanent seat form 80(0). And this includes in respect of thigh-hugging side rises 122, the central pommel portion 116, and hip hugging sidewalls 126. Hence the booster seat insert 86(2) is docked (nested) within the permanent seat form 80(0) in such a way to eliminate lateral movement (here, lateral refers to the left and right of the seated passenger).

Figure 19:
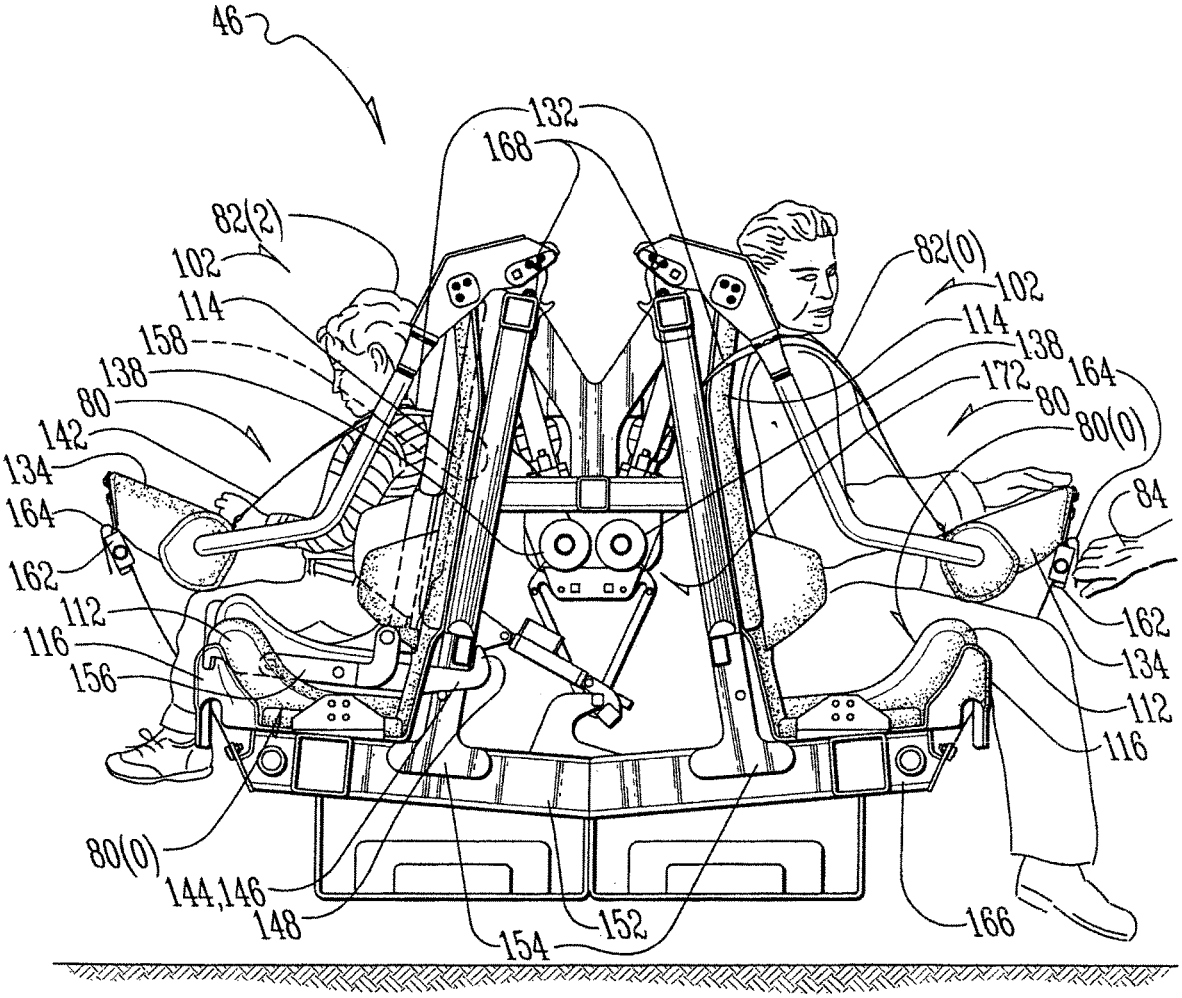
FIG. 19 is a side elevational view comparable to FIG. 18 except showing lap bar restraints lowered and locked, as well as showing the shoulder straps taut.

FIG. 19 shows the lap bar restraints 134 lowered and locked for both passengers 82(0) and 82(2). The shoulder straps are pulled taut by reel devices 138 which will be more particularly described below. Each seat station 102 is provided with a central lanyard 162 wound up on its reel device 164 mounted on the outboard frame 166 of the swinging passenger-carrier 46. A ride attendant/operator 84 would pull out the central lanyard 162 and fasten it to the lap bar restraint 134. The lap bar restraints 134 have their own locking system 168 for locking them down. The lanyard 162 provides a second assurance that the lap bar restraints 134 remain locked down.

Figure 20:
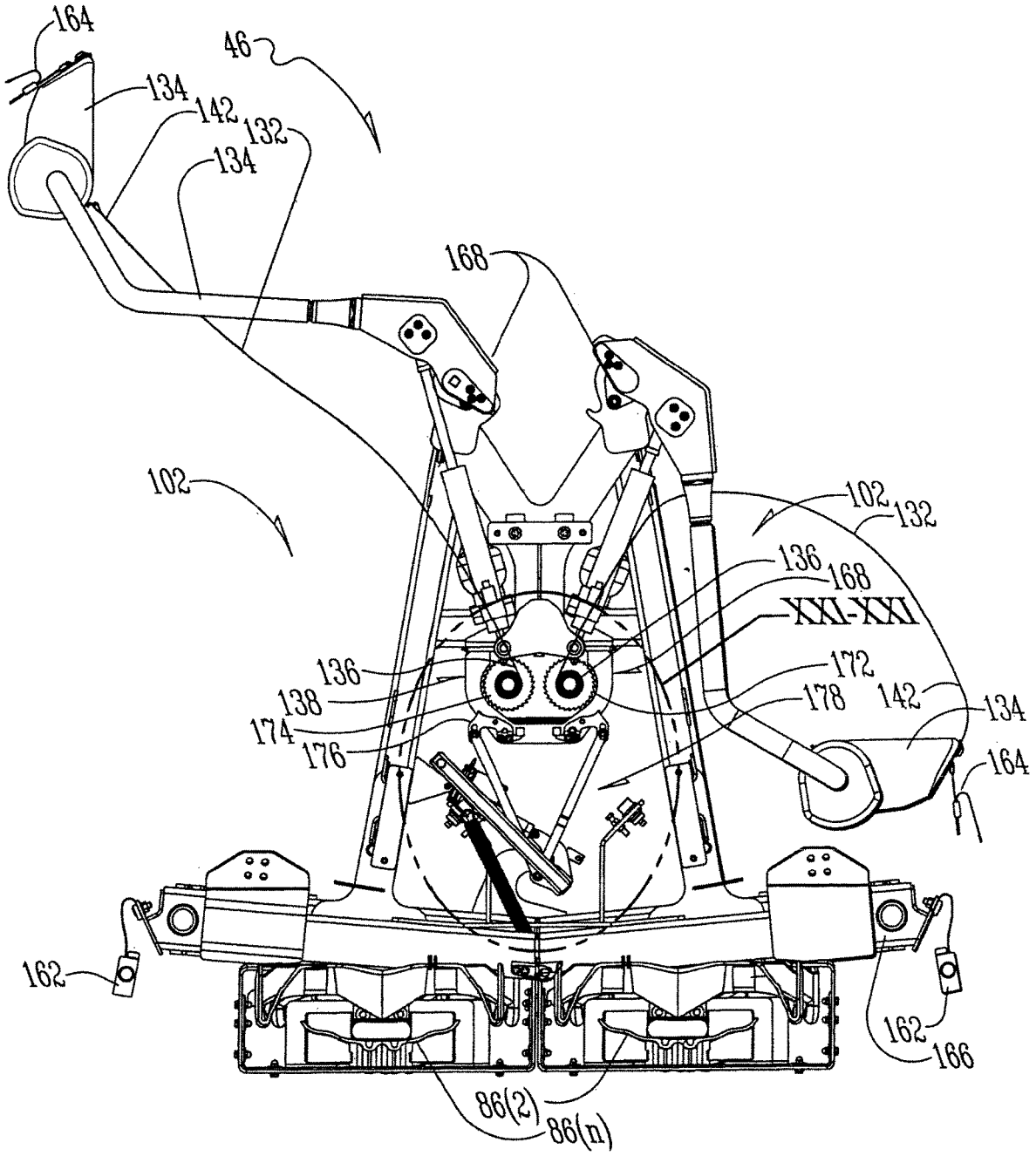
FIG. 20 is a side elevational view comparable to FIG. 19 except showing (1) the passengers removed from the view, (2) the left-side lap bar restraint raised, (3) the ratchet mechanism disengaged, which ratchet mechanisms free and/or lock reeling devices which reel in the shoulder straps taut or else lets the shoulder straps unreel out with the raising of the lap bar restraint.

In FIG. 20, the passengers 80 are now removed from the view, as is the left-side booster seat insert 86(2). The lanyards 162 are undone. The left-side lap bar restraint 134 is raised and the attached shoulder straps 132 have followed up and out. The right-side lap bar restraint 134 is lowered and the shoulder straps 132 are shown in an unnatural arc, but that arc represents the shape the shoulder straps 132 took in FIG. 19 with the extra-large sized passenger 82(0) onboard.

The shoulder straps 132 are provided with reel devices 138 and ratchet mechanisms 172 to control their locked (and taut) as well as unlocked (and unreel to pulling forces) states. The ratchet mechanisms 172 comprise a ratchet gear 174 and a pawl 176. The locked state comprises the pawl 176 engaged with the respective ratchet gear 174 (see FIG. 22). The unlocked state comprises the pawl 176 disengaged with the respective ratchet gear 174 (see FIG. 21). The reel devices 138 function as negators (eg., constant pressure reeling-in devices). When the ratchet mechanisms 172 are unlocked, the reeling devices 138 want to continue to reel in the slack of the shoulder straps 132, but the reeling devices 138 will yield to a pulling force such that extra length of the shoulder straps 132 can be pulled out. When the lap bar restraints 134 are lowered, the shoulder straps 132 pull tight around the seated passenger 82, and the ratchet mechanisms 172 are locked.

Figure 21:
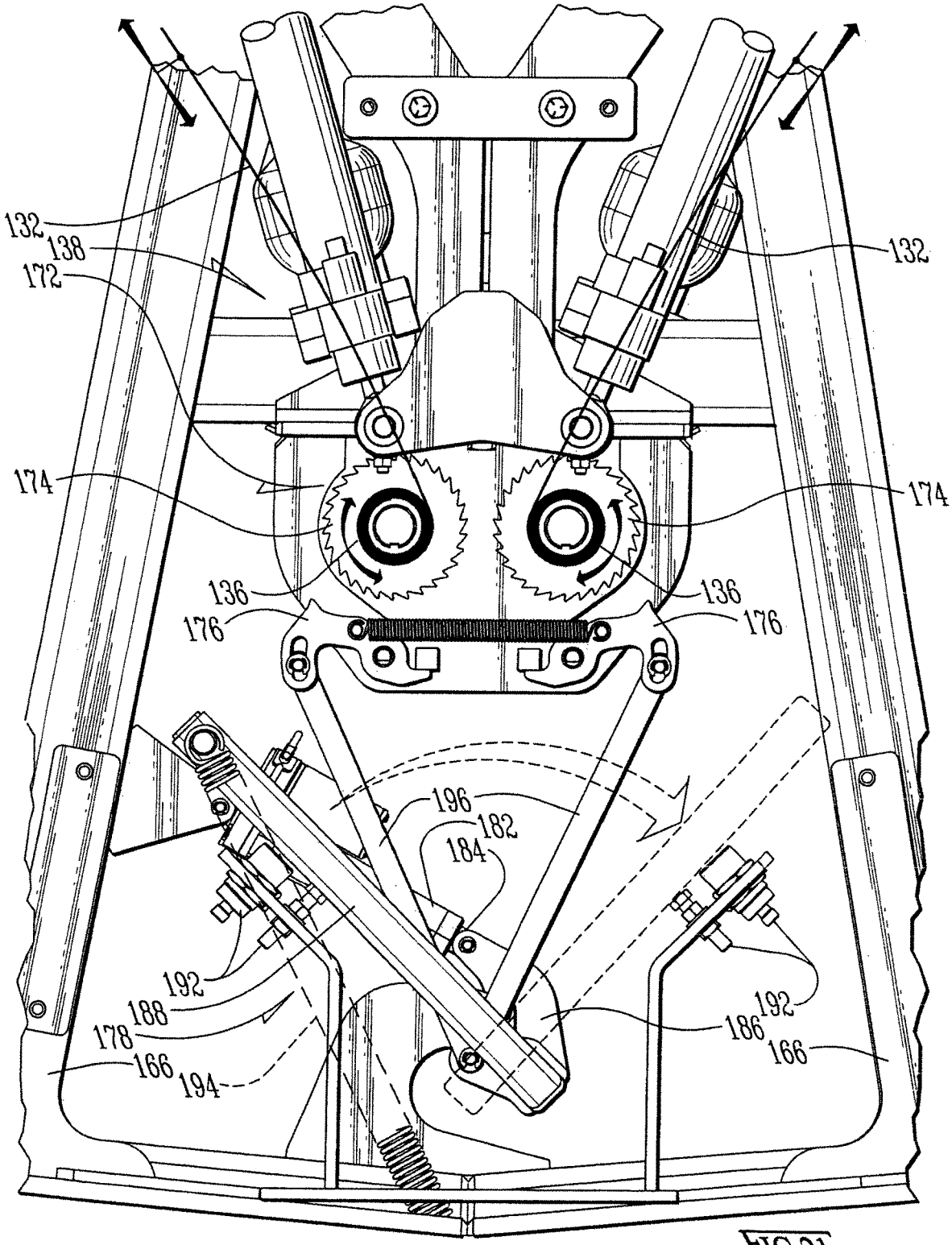
FIG. 21 is an enlarged-scale side elevational view of detail XXI-XXI in FIG. 20, and showing the ratchet pawls dis-engaged with their respective ratchet gears.
Figure 22:
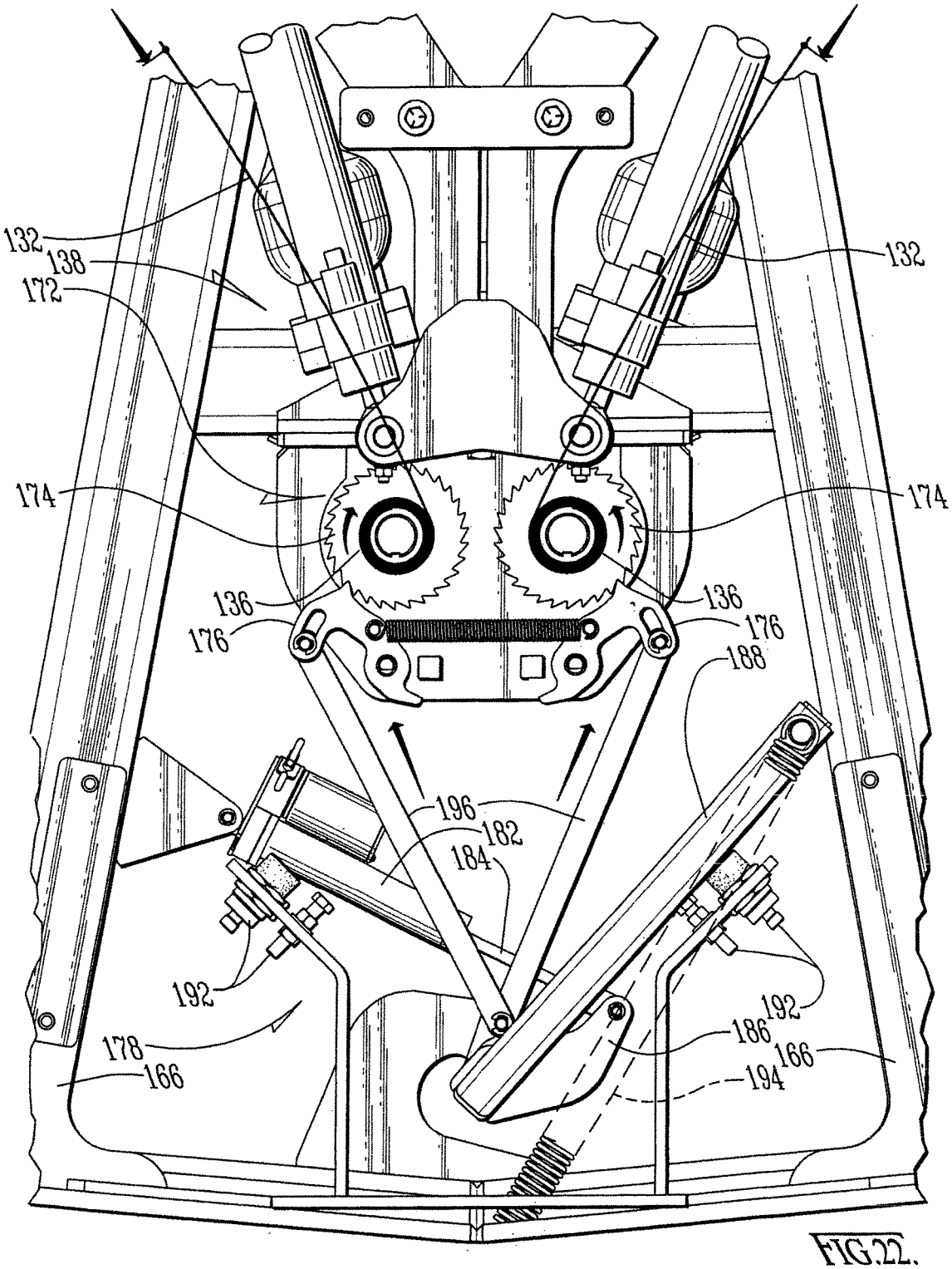
FIG. 22 is a side elevational view comparable to FIG. 21, except showing the ratchet pawls now engaged with their respective ratchet gears.

FIGS. 21 and 22 show better the workings of the ratchet-locking system 178 for the ratchet mechanisms 172. The ratchet-locking system 178 comprises a linear actuator 182, with a drive rod 184 driving a short rocking arm 186 between clockwise and counter-clockwise extremes. The short rocking arm 186 correspondingly drives a relatively longer over-center toggle 188 likewise between clockwise and counter-clockwise extremes. There are corresponding clockwise and counter-clockwise stops 192 for the toggle 188 in the respective clockwise and counter-clockwise extremes. A coil tension spring 194 pulls the toggle 188 over center and tends to pull/urge the toggle 188 to remain in its respective clockwise or counter-clockwise extreme. Until, that is, the linear actuator 182 drives the short rocking arm 186 and hence the toggle 188 to the other extreme.

The toggle 188 and/or the short rocking arm 186 drive a pair of drive rods 196 in back and forth strokes. The down stroke shown in FIG. 21 corresponds to both the over-center toggle 188 in the counter-clockwise extreme therefor and the pawls 176 pulled away from the ratchet gears 174. Hence this is the unlocked state for the ratchet mechanism 172.

The up stroke shown in FIG. 22 corresponds to both the over-center toggle 188 in the clockwise extreme therefor and the pawls 176 indeed engaged with the ratchet gears 174. Hence this is the locked state for the ratchet mechanism 172.

When the ratchet mechanism 172 is locked, the shoulder straps 132 cannot be pulled out. When unlocked, the shoulder straps 132 can only be pulled out by overcoming the negator force of the reel devices 138.

The linear actuator 182 can be any of electric, hydraulic or pneumatic powered. Preferably the operation of the linear actuator 182 is controlled by or keyed by motion of the lap bar restraints 134.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

What is claimed is:

1. An improvement for amusement ride apparatus providing an amusement ride for a plurality of passengers one amusement ride at a time, any given amusement ride being characterized by an embarkation location and time permitting the loading of a plurality of passengers at a beginning time for that given amusement ride, and being further characterized by a debarkation location for off-loading the loaded passenger or passengers at a spaced apart debarkation time for that given amusement ride later than the embarkation time for that given amusement ride; the improvement comprising:

a passenger carrier;

each passenger carrier comprising a plurality of seat stations;

each seat station providing seating for a single passenger;

at least one nesting seat insert for removable docking into and undocking out of the seat station between amusement rides whereby as adapted to be performed by an attendant for the amusement ride apparatus; and a smaller-sized nesting seat insert complementing the one nesting seat insert whereby there are at least two nesting seat inserts, each sized for a different sized passenger, wherein the smaller-sized nesting seat insert has a seat form sized and contoured to provide seating for a diminutive passenger, and comprising a seat portion and a back-rest portion which fold with respect to each other such that when folded together the smaller-sized nesting insert forms a collapsed configuration adapted for docking and undocking operation, and for storage during non-use;

wherein the at least one nesting seat insert has a seat form sized to provide seating for a large passenger, and comprises a seat portion and a back-rest portion which fold with respect to each other such that when folded together the at least one nesting seat insert forms a collapsed configuration adapted for docking and undocking operation, and for storage during non-use;

the seat portion and back-rest portion of the seat station serves as a permanent seat form sized to provide seating for an extra-large passenger; and the passenger carrier further comprising plural storage housings under plural ones of the seat portions of the seat stations for storing the at least one nesting seat insert and the smaller-sized seat insert during non-use whereby providing storage during amusement rides;

whereby the permanent seat form of the seat station for extra-large passengers and the two nesting seat inserts for diminutive and large sized passengers respectively affords the attendant for the amusement ride apparatus three options for seat sizes.

2. The improvement of claim 1, wherein:

a representative amusement ride time is defined as an average difference between the embarkation time and the debarkation time, as averaged over a sample of a plurality of amusement rides for a given part of a day; and a representative cycle time for offloading the passenger or passengers of a just-finished amusement ride and the loading of a passenger or passengers for a next-succeeding amusement ride is defined as an average difference between the debarkation time of the just-finished amusement ride and the embarkation time of the next-succeeding amusement ride, as averaged over a sample of a plurality of a plurality of amusement rides for a given part of a day;

wherein the representative amusement ride time is measured in minutes not hours; and the representative cycle time is measured in minutes not hours.

3. The improvement of claim 1, further comprising:

a medium-sized nesting seat insert complementing the one nesting seat insert, the smaller-sized nesting seat insert and the seat station, whereby respectively affording the attendant for the amusement ride apparatus four options for seat sizes.

4. The improvement of claim 1, wherein:

the seat portion of each nesting booster seat insert has an under surface contour and the back-rest portion of each nesting seat insert has a back surface contour; and each nesting seat insert nests within the permanent seat form of the seat station with the under surface contour and the back-rest portion of each nesting seat insert has a back surface contour of the respective nesting seat insert making conforming contour matching with provisions and contours of the seat portion and back-rest portion of the permanent seat form.

5. The improvement of claim 4, wherein:

the passenger carrier comprises, for each station, a pair of lugs, cross bar or pair of cross bars proximate a rear margin of the seat portion of the permanent seat form; and each nesting seat insert comprises a laterally-spaced pair of steel hooks extending rearwardly out of the respective seat portion;

the laterally-spaced pair of steel hooks each nesting seat insert are sized and configured for making an acute angle flight path into the permanent seat form for hook up with the pair of lugs, cross bar or pair of cross bars proximate a rear margin of the seat portion of the permanent seat form and thus docking of the respective nesting seat insert;

as well as, proximate the same an acute angle flight path for removal of the respective nesting seat insert.

6. The improvement of claim 4, wherein:

the plurality of seat stations comprises two seat stations arranged back-to-back.

7. The improvement of claim 4, wherein:

the plurality of seat stations comprises a plurality of two seat stations arranged back-to-back.

8. The improvement of claim 7, wherein:

the plurality of seat stations comprise any of four to six, eight, ten or twelve seat stations arranged in back-to-back pairs.

9. The improvement of claim 4, wherein:

the amusement ride apparatus provides an amusement ride that at various times tilts the passenger carrier, and thereby the seat stations, from a characteristic plane defined by the orientation of the passenger carrier during passenger loading to at least one plane in excess of a forty-five degree (45°) angularly apart therefrom; and the amusement ride apparatus further comprises a drive system for driving the passenger carrier in a transit path from the embarkation location and debarkation location, which are about the same location or at least relatively proximate each other.

10. The improvement of claim 9, wherein:

the amusement ride further comprises at least a pair of spokes from which the passenger carrier is suspended.

11. An improvement for amusement ride apparatus providing an amusement ride for a plurality of passengers one amusement ride at a time, any given amusement ride being characterized by an embarkation location and time permitting the loading of a plurality of passengers at a beginning time for that given amusement ride, and being further characterized by a debarkation location for off-loading the loaded passenger or passengers at a spaced apart debarkation time for that given amusement ride later than the embarkation time for that given amusement ride; the improvement comprising:

a passenger carrier;

each passenger carrier comprising a plurality of seat stations;

each seat station providing seating for a single passenger;

the seat station has a permanent seat form which serves as a dock for receiving a nesting seat insert;

the permanent seat form has a seat portion and back-rest portion;

the nesting seat insert nests within the permanent seat form of the seat station;

the nesting seat insert has a seat portion and a back-rest portion which fold with respect to each other such that when folded together the nesting insert forms a collapsed configuration adapted for docking and undocking operation, and for storage during non-use; and the passenger carrier further comprises a storage housing under at least one of the seat rides.

12. The improvement of claim 11, wherein:

the nesting seat insert has a seat form sized and contoured to provide seating for a smaller passenger than for the permanent seat form.

13. The improvement of claim 11, wherein:

the passenger carrier comprises, for each station, a pair of lugs, cross bar or pair of cross bars proximate a rear margin of the seat portion of the permanent seat form; and the nesting seat insert comprises a laterally-spaced pair of steel hooks extending rearwardly out of the respective seat portion;

the laterally-spaced pair of steel hooks the nesting seat insert are sized and configured for making an acute angle flight path into the permanent seat form for hook up with the pair of lugs, cross bar or pair of cross bars proximate a rear margin of the seat portion of the permanent seat form and thus docking of the nesting seat insert;

as well as, proximate the same an acute angle flight path for removal of the respective nesting seat insert.

14. The improvement of claim 13, wherein:

the amusement ride apparatus provides an amusement ride that at various times tilts the passenger carrier, and thereby the seat stations, from a characteristic plane defined by the orientation of the passenger carrier during passenger loading to at least one plane in excess of a forty-five degree (45°) angularly apart therefrom; and the amusement ride apparatus further comprises a drive system for driving the passenger carrier in a transit path from the embarkation location and debarkation location, which are about the same location or at least relatively proximate each other.

15. The improvement of claim 13, wherein:

the plurality of seat stations comprises two seat stations arranged back-to-back.

16. The improvement of claim 13, wherein:

the plurality of seat stations comprises a plurality of two seat stations arranged back-to-back.

17. The improvement of claim 13, wherein:

the plurality of seat stations comprise any of four to six, eight, ten or twelve seat stations arranged in back-to-back pairs.

* * * * *